US011731233B2

(12) United States Patent
Takahashi et al.

(10) Patent No.: US 11,731,233 B2
(45) Date of Patent: Aug. 22, 2023

(54) EDDY CURRENT DETECTION DEVICE AND POLISHING APPARATUS

(71) Applicant: EBARA CORPORATION, Tokyo (JP)

(72) Inventors: Taro Takahashi, Tokyo (JP); Hiroaki Shibue, Tokyo (JP); Shinpei Tokunaga, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 636 days.

(21) Appl. No.: 16/677,288

(22) Filed: Nov. 7, 2019

(65) Prior Publication Data

US 2020/0147747 A1 May 14, 2020

(51) Int. Cl.
*B24B 37/013* (2012.01)
*B24B 49/10* (2006.01)

(52) U.S. Cl.
CPC ..... *B24B 37/013* (2013.01); *B24B 49/105* (2013.01)

(58) Field of Classification Search
CPC ..... B24B 7/228; B24B 37/013; B24B 37/20; B24B 37/07; B24B 37/08; B24B 37/105; B24B 37/005; B24B 49/04; B24B 49/10; B24B 49/105
USPC ..... 451/5, 8
See application file for complete search history.

(56) References Cited

U.S. PATENT DOCUMENTS 5,399,968 A * 3/1995 Sheppard ..... G01N 27/904 324/262
6,663,469 B2 * 12/2003 Kimura ..... H01L 21/02074 451/36
7,046,001 B2 * 5/2006 Tada ..... G01B 7/105 324/76.39
7,626,383 B1 * 12/2009 Sun ..... G01N 27/82 324/242
8,106,651 B2 * 1/2012 Lahiri ..... H01L 22/26 324/229
8,657,644 B2 * 2/2014 Tada ..... B24B 49/105 451/5
9,632,061 B2 * 4/2017 Takahashi ..... H01L 22/26
11,004,708 B2 * 5/2021 Iravani ..... H01L 21/67253
2007/0082582 A1 4/2007 Gwo et al.
2010/0124792 A1 5/2010 Iravani et al.
2012/0293188 A1 11/2012 Nikolenko et al.
(Continued)

FOREIGN PATENT DOCUMENTS

JP H07-116732 A 5/1995
JP 2002-254302 A 9/2002
(Continued)

*Primary Examiner* — Orlando E Aviles
*Assistant Examiner* — Robert F Neibaur
(74) *Attorney, Agent, or Firm* — BakerHostetler

(57) ABSTRACT

An eddy current detection device configured to form a stronger magnetic field in a polishing target and a polishing apparatus employing the same eddy current detection device are provided. An eddy current detection device that can be disposed near a semiconductor wafer on which a conductive film is formed includes a plurality of eddy current sensors. The plurality of eddy current sensors are disposed near to one another. Each of the plurality of eddy current sensors includes a pot core, an exciting coil disposed in the pot core and configured to form an eddy current in the conductive film, and a detection coil disposed in the pot core and configured to detect the eddy current formed in the conductive film.

11 Claims, 19 Drawing Sheets

(56) References Cited

U.S. PATENT DOCUMENTS

| | | | | |
|---|---|---|---|---|
| 2015/0258654 | A1* | 9/2015 | Shinozaki | H01L 21/67092 156/345.13 |
| 2018/0056476 | A1 | 3/2018 | Zhang et al. | |
| 2018/0122667 | A1 | 5/2018 | Iravani et al. | |
| 2018/0231398 | A1 | 8/2018 | Koizumi et al. | |

FOREIGN PATENT DOCUMENTS

| | | | |
|---|---|---|---|
| JP | 2017-058245 | A | 3/2017 |
| WO | WO 2017/126341 | A1 | 7/2017 |

* cited by examiner

EDDY CURRENT DETECTION DEVICE AND POLISHING APPARATUS

FIELD OF THE INVENTION

The present invention relates to an eddy current detection device and a polishing apparatus using the eddy current detection device.

BACKGROUND ART

In recent years, with the progress of the higher integration of semiconductor devices, circuit wiring is becoming finer, and an inter-wiring distance is becoming narrower. Therefore, it has been necessary to flatten the surface of a semiconductor wafer as a polishing target, and polishing has been performed by a polishing device as such a means of flattening the surface of the semiconductor wafer.

A polishing apparatus includes a polishing table for holding a polishing pad for polishing a polishing target, and a top ring for pressing the polishing target against the polishing pad while holding the polishing target. Each of the polishing table and the top ring is rotationally driven by a drive section (for example, a motor). A liquid containing polishing agent (slurry) is made to flow on the polishing pad, and the polishing target held by the top ring is pressed against the polishing pad, whereby the polishing target is polished.

In the polishing apparatus, when the polishing target is insufficiently polished, the insulation between circuits cannot be secured, and thus, short-circuiting may occur. Furthermore, when the polishing target is over-polished, there occurs such a problem that the resistance value of a wire increases due to reduction in the cross-sectional area of the wire, or a wire itself is completely removed, and thus a circuit itself is not formed. To cope with these problems, the polishing apparatus is required to detect an optimal polishing end point.

Then, Japanese Patent Laid-Open No. 2017-58245 describes such a technique. In this technique, an eddy current sensor using a so-called pod-type coil is used to detect a polishing end point.

CITATION LIST

Patent Literature

PTL 1: Japanese Patent Laid-Open No. 2017-58245

SUMMARY

In a first aspect of the present invention, a configuration is adopted in which there is provided an eddy current detection device capable of being disposed near a polishing target on which a conductive film is formed, the eddy current detection device including a plurality of eddy current sensors, the plurality of eddy current sensors being disposed near to each other, and each of the plurality of eddy current sensors includes a core section, an exciting coil disposed in the core section and configured to form an eddy current in the conductive film, and a detection coil disposed in the core section and configured to detect the eddy current formed in the conductive film.

In a second aspect, a configuration based on the eddy current detection device according to the first aspect is adopted. In this configuration, in at least one eddy current sensor of the plurality of eddy current sensors, the exciting coil and the detection coil constitute the same coil, and the exciting coil can detect the eddy current formed in the conductive film.

In a third aspect, a configuration based on the eddy current detection device according to the first aspect or second aspect is adopted. In this configuration, in at least one eddy current sensor of the plurality of eddy current sensors, the core section includes a bottom surface portion, a magnetic center portion provided at a center of the bottom surface portion, and a circumferential portion provided on a circumference of the bottom surface portion, and the exciting coil and the detection coil are disposed at the magnetic center portion.

In a fourth aspect, a configuration based on the eddy current detection device according to the third aspect is adopted. In this configuration, the exciting coil and the detection coil are disposed at the circumferential portion, in addition to the magnetic center portion.

In a fifth aspect, a configuration based on the eddy current detection device according to the third or fourth aspect is adopted. In this configuration, the circumferential portion constitutes a circumferential wall portion that is provided on a circumference of the bottom surface portion in such a manner as to surround the magnetic center portion.

In a sixth aspect, a configuration based on the eddy current detection device according to the third or fourth aspect is adopted. In this configuration, the bottom surface portion has a pillar-like shape, and the circumferential portion is disposed at both ends of the pillar-like shape.

In a seventh aspect, a configuration based on the eddy current detection device according to the third or fourth aspect is adopted. In this configuration, a plurality of circumferential portions are provided on the circumference of the bottom surface portion.

In an eighth aspect, a configuration based on the eddy current detection device according to the first or second aspect is adopted. In this configuration, in at least one eddy current sensor of the plurality of eddy current sensors, the core section includes a bottom surface portion and a plurality of pillar-like portions extending from the bottom surface portion in a normal direction towards the polishing target, and the plurality of pillar-like portions include a plurality of first pillar-like portions that can generate a first magnetic polarity and a plurality of second pillar-like portions that can generate a second magnetic polarity that is opposite to the first magnetic polarity.

In a ninth aspect, a configuration based on the eddy current detection device according to any one the first to eighth aspects is adopted. In this configuration, the plurality of eddy current sensors are disposed, to form a polygon, at vertices of the polygon and/or along sides of the polygon and/or in an interior of the polygon.

In a tenth aspect, a configuration based on the eddy current detection device according to any one of the first to eighth aspects is adopted. In this configuration, the plurality of eddy current sensors are disposed, to form a straight line, on the straight line.

In an eleventh aspect, a configuration is adopted in which there is provided a polishing apparatus including a polishing table to which a polishing pad for polishing a polishing target can be affixed, a drive section configured to rotationally drive the polishing table, a holding section configured to press the polishing target against the polishing pad by holding the polishing target, the eddy current detection device according to any one of the first to tenth aspects that is disposed in an interior of the polishing table, wherein the eddy current formed in the polishing target by the exciting coil in association with rotation of the polishing table is detected by the detection coil, and an end point detecting section configured to detect a polishing end point indicating an end of polishing of the polishing target from the detected eddy current.

BRIEF DESCRIPTION OF DRAWINGS

FIGS. 13A and 13B are diagrams illustrating a configuration of the eddy current sensor, in which FIG. 13A is a block diagram illustrating the configuration of the eddy current sensor, and FIG. 13B is an equivalent circuit diagram of the eddy current sensor;

DESCRIPTION OF EMBODIMENTS

Hereinafter, embodiments of the present invention will be described with reference to drawings. Note that in each of the following embodiments, like signs will be given to like or corresponding members, and the repetition of similar descriptions may be omitted. Features shown in one embodiment may be applied to the other embodiments as long as these features do not contradict one another.

Figure 1:
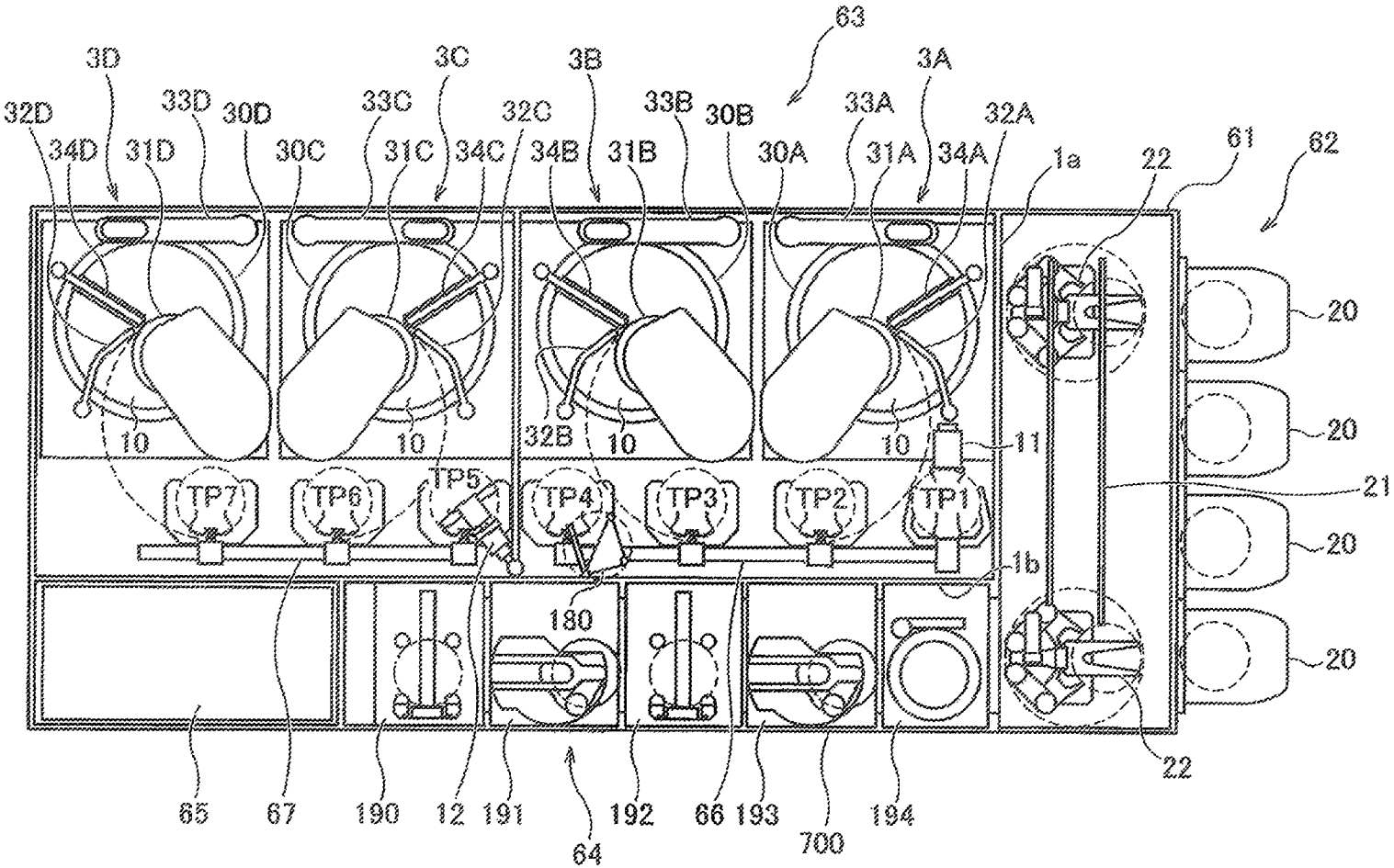
FIG. 1 is a plan view illustrating an overall configuration of a substrate processing apparatus according to an embodiment of the present invention.

FIG. 1 is a plan view illustrating an overall configuration of a substrate processing apparatus according to one embodiment of the present invention. As illustrated in FIG. 1, the substrate processing apparatus includes a casing, that is, a housing 61 having a substantially rectangular shape in the present embodiment. The housing 61 includes a side wall 700. An interior of the housing 61 is partitioned into a load/unload section 62, a polishing section 63, and a cleaning section 64 by partition walls 1*a* and 1*b*. Each of the load/unload section 62, the polishing section 63 and the cleaning section 64 is independently assembled and independently evacuated. Furthermore, the substrate processing apparatus also includes a control section 65 that controls a substrate processing operation.

The load/unload section 62 includes two or more (four in the present embodiment) front load units 20, in each of which a wafer cassette where many semiconductor wafers (substrates) are stocked is mounted. The front load units 20 are disposed adjacent to the housing 61 and arranged along a width direction (a direction perpendicular to a longitudinal direction) of the substrate processing apparatus. Each front load unit 20 is configured such that an open cassette, an SMIF (Standard Manufacturing Interface) pod, or an FOUP (Front Opening Unified Pod) can be installed therein. Here, the SMIF and the FOUP each constitute a hermetically sealed container that accommodates a wafer cassette therein and is covered with partition walls so as to keep an independent environment isolated from an external space.

A traveling mechanism 21 is laid out along the arrangement of the front load units 20 in the load/unload section 62. Two transport robots (loaders) 22 are installed on the traveling mechanism 21 in such a manner as to move along the direction in which the wafer cassettes are arranged. The transport robots 22 can access the wafer cassettes installed in the front load units 20 by moving on the traveling mechanism 21. Each transport robot 22 has two hands; an upper hand and a lower hand. The upper hand is used to return a processed semiconductor wafer to a wafer cassette. The lower hand is used to unload a semiconductor wafer before processing from the wafer cassette. In this way, the upper hand and the lower hand are used for the different purposes. Furthermore, the semiconductor wafer can be turned over by causing the lower hand of the transport robot 22 to turn around its shaft center.

The load/unload section 62 is a region which needs to be kept in the cleanest state. Therefore, the interior of the load/unload section 62 is always kept at a pressure higher than that in any of the outside of the substrate processing apparatus, the polishing section 63, and the cleaning section 64. The polishing section 63 is the dirtiest region because a slurry is used as a polishing liquid. Accordingly, a negative pressure is formed inside the polishing section 63 and is kept at a pressure that is lower than the pressure inside the cleaning section 64. A filter fan unit (not illustrated) having a clean air filter such as an HEPA filter, a ULPA filter, or a chemical filter is provided in the load/unload section 62. Clean air from which particles, toxic vapor, or toxic gas has been removed is always blown out from the filter fan unit.

The polishing section 63 is a region where polishing (flattening) of a semiconductor wafer is performed, and includes a first polishing unit 3A, a second polishing unit 3B, a third polishing unit 3C, and a fourth polishing unit 3D. As illustrated in FIG. 1, the first polishing unit 3A, the second polishing unit 3B, the third polishing unit 3C, and the fourth polishing unit 3D are arranged along the longitudinal direction of the substrate processing apparatus.

As illustrated in FIG. 1, the first polishing unit 3A includes a polishing table 30A, a top ring 31A, a polishing liquid supply nozzle 32A, a dresser 33A, and an atomizer 34A. A polishing pad 10 having a polishing surface is attached to the polishing table 30A. The top ring (holding section) 31A holds a semiconductor wafer and polishes the semiconductor wafer while pressing the semiconductor wafer against the polishing pad 10 on the polishing table 30A. The polishing liquid supply nozzle 32A supplies a polishing liquid or a dressing liquid (for example, pure water) to the polishing pad 10. The dresser 33A performs a dressing of the polishing surface of the polishing pad 10. The atomizer 34A ejects a mixed fluid of a liquid (for example, pure water) and gas (for example, nitrogen gas) or a liquid (for example, pure water) in the form of mist to the polishing surface.

Likewise, the second polishing unit 3B includes a polishing table 30B to which a polishing pad 10 is attached, a top ring 31B, a polishing liquid supply nozzle 32B, a dresser 33B, and an atomizer 34B. The third polishing unit 3C includes a polishing table 30C to which a polishing pad 10 is attached, a top ring 31C, a polishing liquid supply nozzle 32C, a dresser 33C, and an atomizer 34C. The fourth polishing unit 3D includes a polishing table 30D to which a polishing pad 10 is attached, a top ring 31D, a polishing liquid supply nozzle 32D, a dresser 33D, and an atomizer 34D.

The first polishing unit 3A, the second polishing unit 3B, the third polishing unit 3C, and the fourth polishing unit 3D have the same configuration as each other. Therefore, for the details of the polishing unit, the first polishing unit 3A will be described below.

Figure 2:
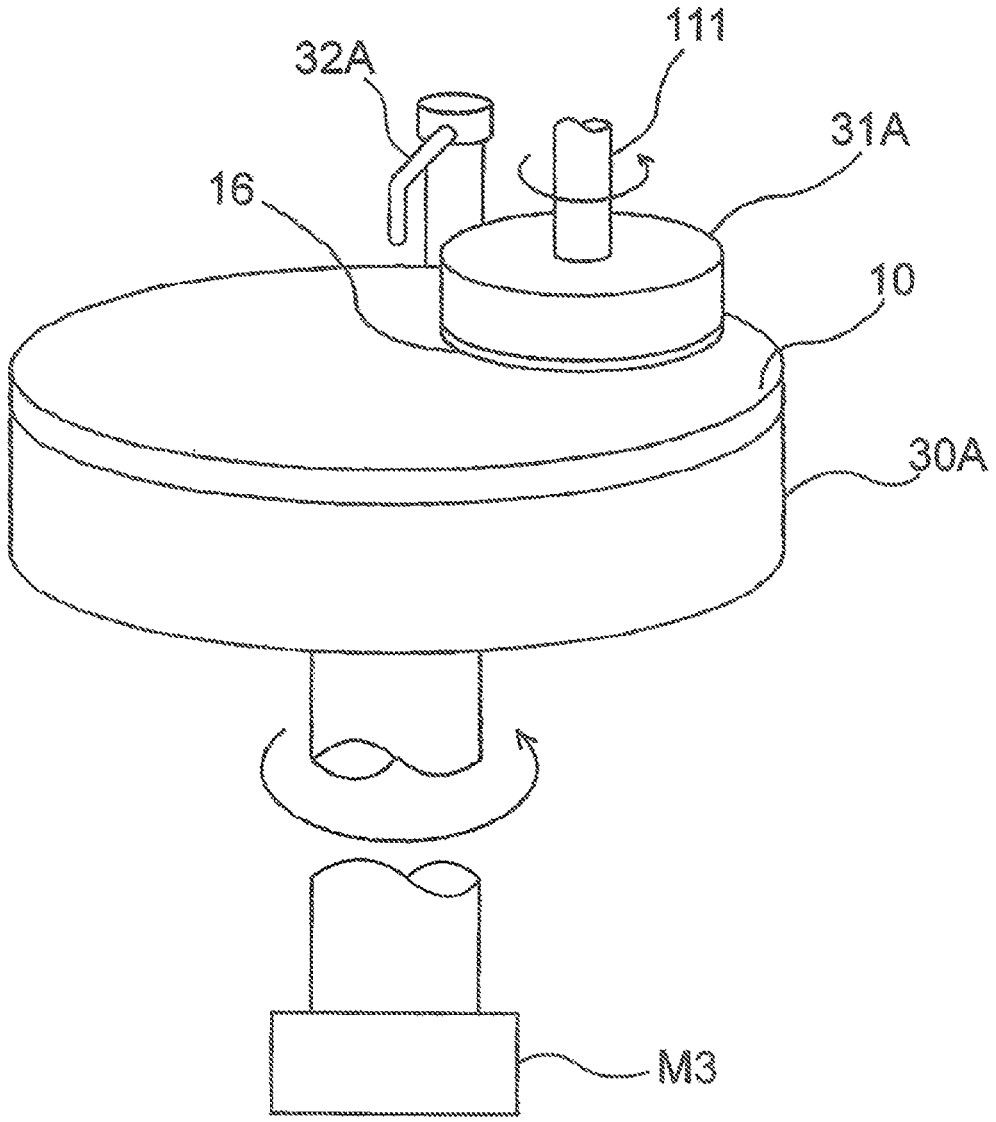
FIG. 2 is a perspective view schematically illustrating a first polishing unit.

FIG. 2 is a perspective view schematically illustrating the first polishing unit 3A. The top ring 31A is supported on a top ring shaft 111. The polishing pad 10 adheres to a top surface of the polishing table 30, and a top surface of the polishing pad 10 constitutes a polishing surface for polishing a semiconductor wafer 16. Note that instead of the polishing pad 10, fixed abrasive grains may be also used. The top ring 31A and the polishing table 30A are configured to rotate around their shaft centers as indicated by arrows. The semiconductor wafer 16 is held on a bottom surface of the top ring 31A by vacuum suction. During polishing, a polishing liquid is supplied to the polishing surface of the polishing pad 10 from the polishing liquid supply nozzle 32A, and the semiconductor wafer 16, which is a polishing target, is pressed against the polishing surface by the top ring 31A, thus being polished.

Figure 3:
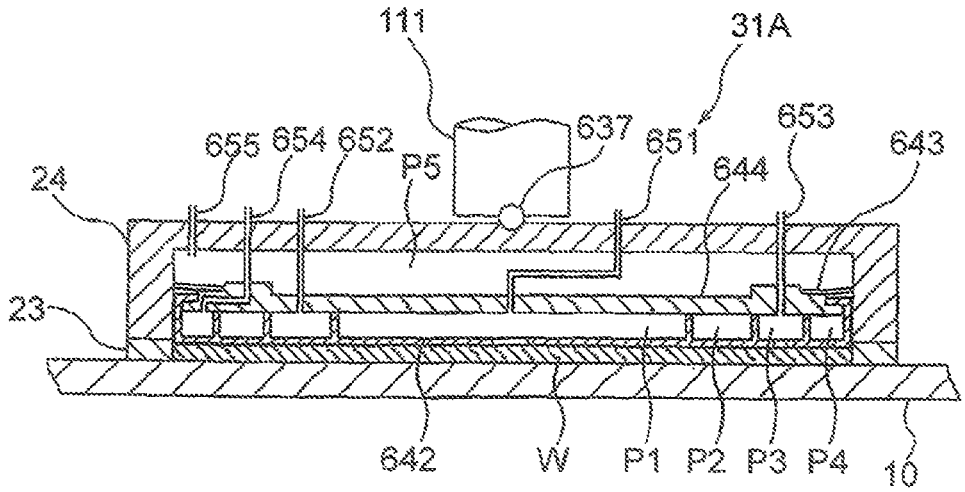
FIG. 3 is a cross-sectional view schematically illustrating a structure of a top ring.

FIG. 3 is a cross-sectional view schematically illustrating a structure of the top ring 31A. The top ring 31A is connected to a lower end of the top ring shaft 111 via a universal joint 637. The universal joint 637 is a ball joint that transmits rotation of the top ring shaft 111 to the top ring 31A while allowing relative tilting between the top ring 31A and the top ring shaft 111. The top ring 31A includes a top ring main body 24 of a substantially circular disk shape and a retainer ring 23 disposed on the bottom of the top ring main body 24. The top ring main body 24 is formed of a material high in strength and rigidity such as a metal or ceramics. The retainer ring 23 is formed of a resin material high in rigidity or ceramics and the like. The retainer ring 23 may be formed integrally with the top ring main body 24.

A circular elastic pad 642 that abuts on the semiconductor wafer 16, an annular pressure sheet 643 made up of an elastic film, and a substantially disk-shaped chucking plate 644 configured to hold the elastic pad 642 are accommodated in a space formed inside the top ring main body 24 and the retainer ring 23. An upper circumferential end of the elastic pad 642 is held to the chucking plate 644, and four pressure chambers (air bags) P1, P2, P3, and P4 are provided between the elastic pad 642 and the chucking plate 644. The pressure chambers P1, P2, P3, and P4 are formed by the elastic pad 642 and the chucking plate 644. A pressurized fluid such as pressurized air is supplied to the pressure chambers P1, P2, P3, and P4 via corresponding fluid paths 651, 652, 653, and 654, or a vacuum is drawn into the pressure chambers P1, P2, P3, and P4 via the fluid paths 651, 652, 653, and 654. The pressure chamber P1 at the center is circular, and the other pressure chambers P2, P3, and P4 are annular. The pressure chambers P1, P2, P3, and P4 are concentrically arranged.

Internal pressures of the pressure chambers P1, P2, P3, and P4 can be changed independently of one another by a pressure adjusting section, which will be described below, whereby pressing forces against four regions, that is, a central portion, an inner intermediate portion, an outer intermediate portion, and a circumferential edge portion of the semiconductor wafer 16 can be independently adjusted. The entire top ring 31A is raised and lowered so that the retainer ring 23 can be pressed against the polishing pad 10 with a predetermined pressing force. A pressure chamber P5 is formed between the chucking plate 644 and the top ring main body 24 so that a pressurized fluid is supplied to the pressure chamber P5 via a fluid path 655 or a vacuum is drawn thereinto via the fluid path 655. This enables the whole of the chucking plate 644 and the elastic pad 642 to move up and down.

The circumferential edge portion of the semiconductor wafer 16 is surrounded by the retainer ring 23 so that the semiconductor wafer 16 is prevented from getting out of the top ring 31A during polishing. An opening (not illustrated) is formed at a portion of the elastic pad 642, which constitutes the pressure chamber P3, and a vacuum is drawn into the pressure chamber P3 so that the semiconductor wafer 16 can be suction held to the top ring 31A. Nitrogen gas, dried air, compressed air, or the like is supplied to the pressure chamber P3 so that the semiconductor wafer 16 is released from the top ring 31A.

Figure 4:
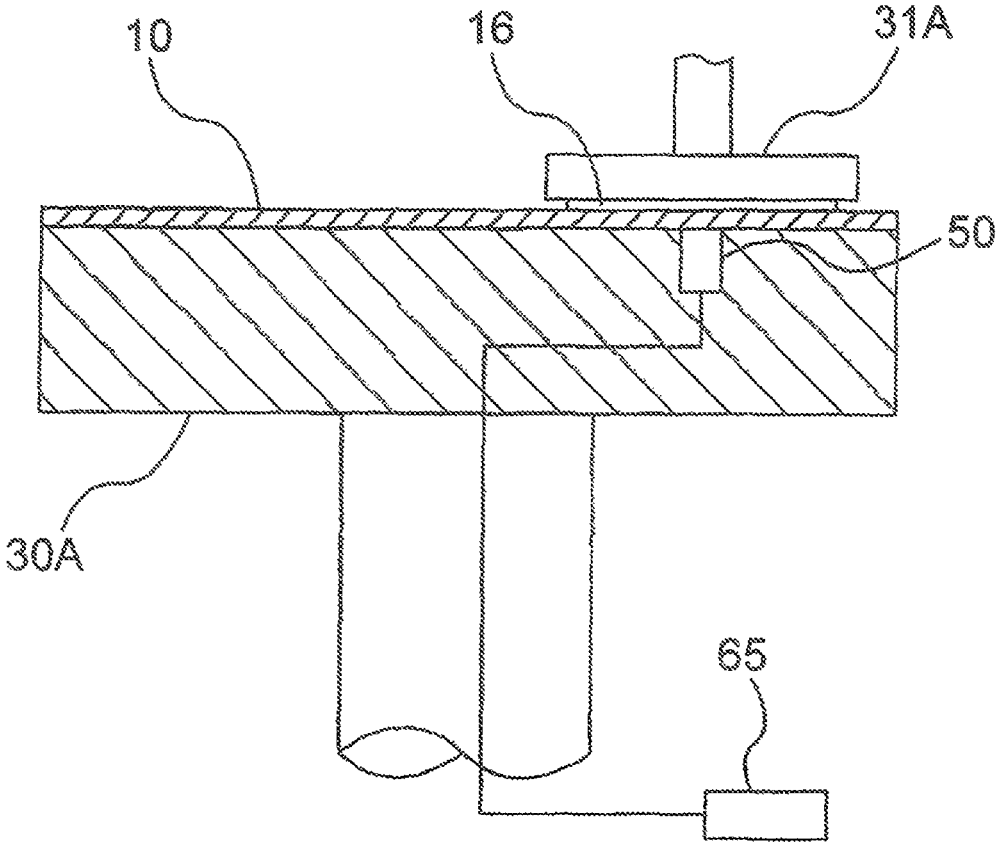
FIG. 4 is a cross-sectional view schematically illustrating an internal structure of a polishing table.

FIG. 4 is a cross-sectional view schematically illustrating an internal structure of the polishing table 30A. As illustrated in FIG. 4, an eddy current detection device 50 configured to detect a state of a film of the semiconductor wafer 16 is embedded in an interior of the polishing table 30A. A signal of the eddy current detection device 50 is transmitted to the control section 65, and the control section 65 generates a monitoring signal representing a film thickness. A value of the monitoring signal (and a sensor signal) does not represent the film thickness itself. However, the value of the monitoring signal changes in accordance with the film thickness. Therefore, the monitoring signal can be a signal representing the film thickness of the semiconductor wafer 16. The control section 65 constitutes an end point detecting section configured to detect a polishing end point indicating an end of polishing of the polishing target from the eddy current detected by the eddy current detection device 50.

The control section 65 determines respective internal pressures of the pressure chambers P1, P2, P3, and P4 based on the monitoring signal, and issues an instruction to a pressure adjusting section 675 so that the determined internal pressures are formed in the pressure chambers P1, P2, P3, and P4. The control section 65 functions as a pressure control section that controls the internal pressures of the pressure chambers P1, P2, P3, and P4 based on the monitoring signal and an end point detecting section that detects a polishing end point.

An eddy current detection device 50 is also provided in each of the second polishing unit 3B, the third polishing unit 3C, and the fourth polishing unit 3D, as in the first polishing unit 3A. The control section 65 generates a monitoring signal from a signal transmitted from a film thickness sensor 76 of each of the polishing units 3A to 3D, and monitors the progress in polishing of the semiconductor wafer in each of the polishing units 3A to 3D. In the case where a plurality of semiconductor wafers are polished at the polishing units 3A to 3D, the control section 65 monitors monitoring signals representing film thicknesses of the semiconductor wafers during polishing and controls pressing forces of the top rings 31A to 31D so that polishing times at the polishing units 3A to 3D are substantially the same based on the monitoring signals. Thus, the pressing forces of the top rings 31A to 31D during polishing are thus controlled based on the monitoring signals, respectively, whereby the polishing times at the polishing units 3A to 3D can be leveled.

The semiconductor wafer 16 may be polished by any one of the first polishing unit 3A, the second polishing unit 3B, the third polishing unit 3C, and the fourth polishing unit 3D, or may be continuously polished by a plurality of polishing units previously selected from the polishing units 3A to 3D. For example, the first polishing unit 3A and the second polishing unit 3B may polish the semiconductor wafer 16 in this order. Alternatively, the third polishing unit 3C and the fourth polishing unit 3D may polish the semiconductor wafer 16 in this order. Furthermore, the first polishing unit 3A, the second polishing unit 3B, the third polishing unit 3C, and the fourth polishing unit 3D may polish the semiconductor wafer 16 in this order. In any case, the polishing times at all the polishing units 3A to 3D are leveled so that throughput can be improved.

The eddy current detection device 50 is preferably used when the film of the semiconductor wafer is a metallic film. In the case where the film of the semiconductor wafer is a film having light transmissivity such as an oxide film, an optical sensor can be used as a film thickness sensor in place of the eddy current detection device 50. Alternatively, a microwave sensor may be used as the film thickness sensor. The microwave sensor can be used for both a metallic film and a nonmetallic film.

Next, referring to FIG. 1, a transport mechanism for transporting a semiconductor wafer will be described. The transport mechanism includes a lifter 11, a first linear transporter 66, a swing transporter 12, a second linear transporter 67, and a temporary placement stand 180.

The lifter 11 receives a semiconductor wafer from the transport robot 22. The first linear transporter 66 transports the semiconductor wafer received from the lifter 11 among a first transport position TP1, a second transport position TP2, a third transport position TP3, and a fourth transport position TP4. The first polishing unit 3A and the second polishing unit 3B receive the semiconductor wafer from the first linear transporter 66 and polish the semiconductor wafer. The first polishing unit 3A and the second polishing unit 3B pass the polished semiconductor wafer to the first linear transporter 66.

The swing transporter 12 delivers the semiconductor wafer between the first linear transporter 66 and the second linear transporter 67. The second linear transporter 67 transports the semiconductor wafer received from the swing transporter 12 among a fifth transport position TP5, a sixth transport position TP6, and a seventh transport position TP7. The third polishing unit 3C and the fourth polishing unit 3D receive the semiconductor wafer from the second linear transporter 67 and polish the semiconductor wafer. The third polishing unit 3C and the fourth polishing unit 3D transfer the polished semiconductor wafer to the second linear transporter 67. The semiconductor wafer polished by the polishing unit 3 is placed on the temporary placement stand 180 by the swing transporter 12.

Figure 5:
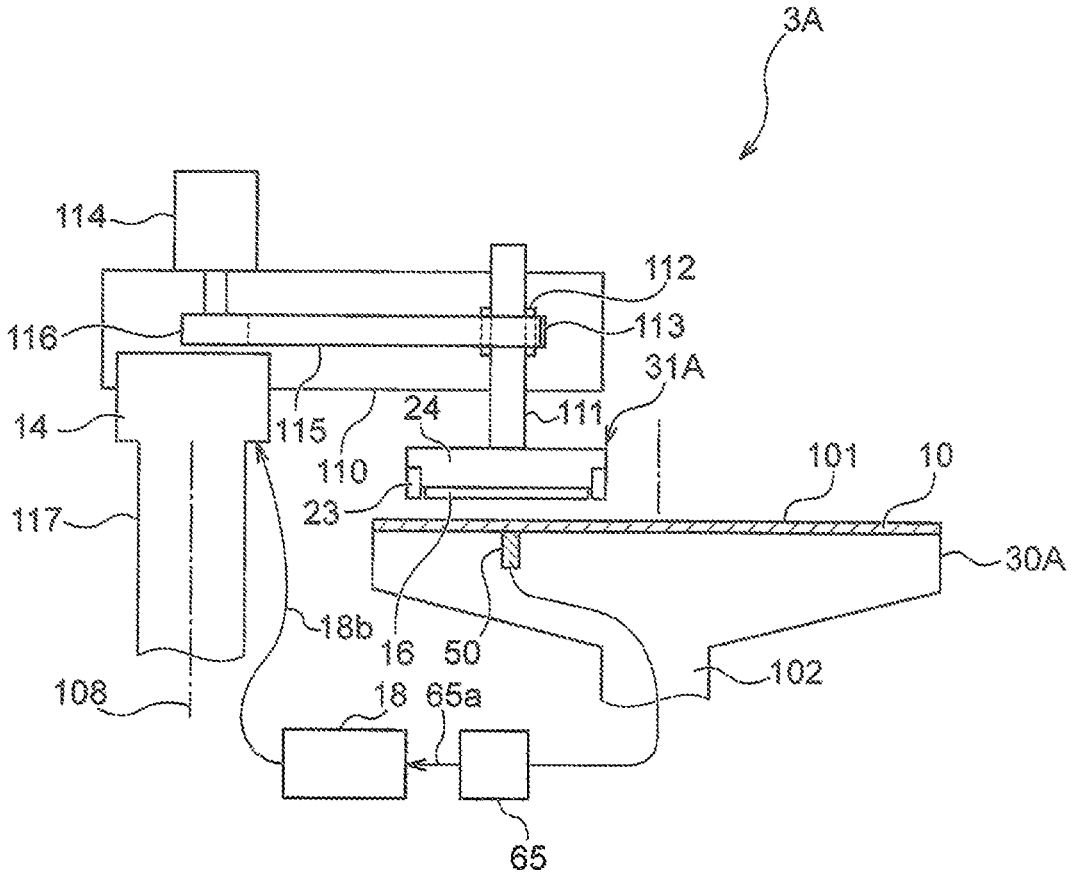
FIG. 5 is a schematic diagram illustrating an overall configuration of a polishing apparatus according to the embodiment of the present invention.

FIG. 5 is a schematic diagram illustrating an overall configuration of the polishing unit (the polishing apparatus) according to the embodiment of the present invention. As illustrated in FIG. 5, the polishing apparatus includes the polishing table 30A, and the top ring 31A (the holding section) that holds a substrate such as a semiconductor wafer 16, which is a polishing target, and presses the substrate against the polishing surface on the polishing table.

The first polishing unit 3A is a polishing unit for performing polishing between the polishing pad 10 and the semiconductor wafer 16 disposed facing the polishing pad 10. The first polishing unit 3A includes the polishing table 30A for holding the polishing pad 10, and the top ring 31A for holding the semiconductor wafer 16. The first polishing unit 3A includes a swing arm 110 for holding the top ring 31A, a swing shaft motor 14 for causing the swing arm 110 to swing, and a driver 18 that supplies drive power to the swing shaft motor 14.

According to a plurality of embodiments that will be described by reference to FIGS. 5 to 21, the accuracy with which a polishing end point is detected can be improved. In the present embodiment, a method based on an eddy current is adopted as a polishing end point detection means.

The top ring (the holding section) 31A, the swing arm 110, the arm drive section (the swing shaft motor 14), and the end point detecting section form a set, and these sets are provided individually in the first polishing unit 3A, the second polishing unit 3B, the third polishing unit 3C, and the fourth polishing unit 3D.

The polishing table 30A is connected to a motor M3 (refer to FIG. 2), which is a drive section, disposed therebelow via a table shaft 102 and can rotate around the table shaft 102. The polishing pad 10 is affixed to the top surface of the polishing table 30A, and a surface 101 of the polishing pad 10 constitutes a polishing surface for polishing a semiconductor wafer 16. A polishing liquid supply nozzle (not illustrated) is provided above the polishing table 30A, and the polishing liquid supply nozzle supplies a polishing liquid Q to the polishing pad 10 on the polishing table 30A. As illustrated in FIG. 5, the eddy current detection device 50 is embedded in the interior of the polishing table 30A, and this eddy current detection device 50 can generate an eddy current in a semiconductor wafer 16 and detect a polishing end point by detecting the eddy current so generated The top ring 31A includes the top ring main body 24 that presses a semiconductor wafer 16 against the polishing surface 101 and the retainer ring 23 that holds an outer circumferential edge of the semiconductor wafer 16 so as to prevent the semiconductor wafer 16 from getting out of the top ring.

The top ring 31A is connected to the top ring shaft 111. The top ring shaft 111 is caused to move up and down relative to the swing arm 110 by an up-and-down motion mechanism, which is not illustrated. The up-and-down motion of the top ring shaft 111 causes the entire top ring 31A to ascend or descend and causes it to be positioned relative to the swing arm 110.

The top ring shaft 111 is connected to a rotary cylinder 112 via a key (not illustrated). The rotary cylinder 112 includes a timing pulley 113 provided on an outer circumferential portion thereof. A top ring motor 114 is fixed to the swing arm 110. The above-described timing pulley 113 is connected to a timing pulley 116 provided on the top ring motor 114 via a timing belt 115. As the top ring motor 114 rotates, the rotary cylinder 112 and the top ring shaft 111 integrally rotate via the timing pulley 116, the timing belt 115, and the timing pulley 113, and thus the top ring 31A rotates.

The swing arm 110 is connected to a rotation shaft of the swing shaft motor 14. The swing shaft motor 14 is fixed to a swing arm shaft 117. Therefore, the swing arm 110 is rotatably supported by the swing arm shaft 117.

The top ring 31A can hold a substrate such as a semiconductor wafer 16 to an undersurface thereof. The swing arm 110 can turn around the swing arm shaft 117. The top ring 31A that holds the semiconductor wafer 16 to its undersurface is moved from a receiving position of a semiconductor wafer 16 to a position above the polishing table 30A as the swing arm 110 turns. Then, the top ring 31A is caused to descend to press the semiconductor wafer 16 against the surface (polishing surface) 101 of the polishing pad 10. At this time, each of the top ring 31A and the polishing table 30A is caused to rotate. At the same time, the polishing liquid is supplied onto the polishing pad 10 from the polishing liquid supply nozzle provided above the polishing table 30A. In this way, the surface of the semiconductor wafer 16 is polished by bringing the semiconductor wafer 16 into sliding contact with the polishing surface 101 of the polishing pad 10.

The first polishing unit 3A includes a table drive section (not illustrated) that drives to rotate the polishing table 30A. The first polishing unit 3A may include a table torque detection section (not illustrated) configured to detect table torque applied to the polishing table 30A. The table torque detection section can detect table torque from the current of the table drive section, which is a rotation motor. The control section 65 may detect a polishing end point indicating an end of polishing only from the eddy current detected by the eddy current detection device 50 or may detect a polishing end point indicating an end of polishing in taking arm torque detected by an arm torque detection section or the table torque into consideration.

Figure 6A:
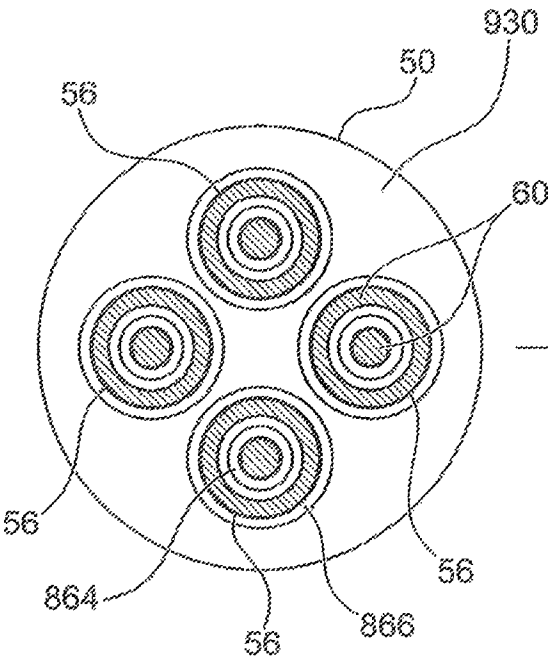
FIGS. 6A to 6C are plan views illustrating an eddy current detection device according to the embodiment of the present invention.
Figure 6B:
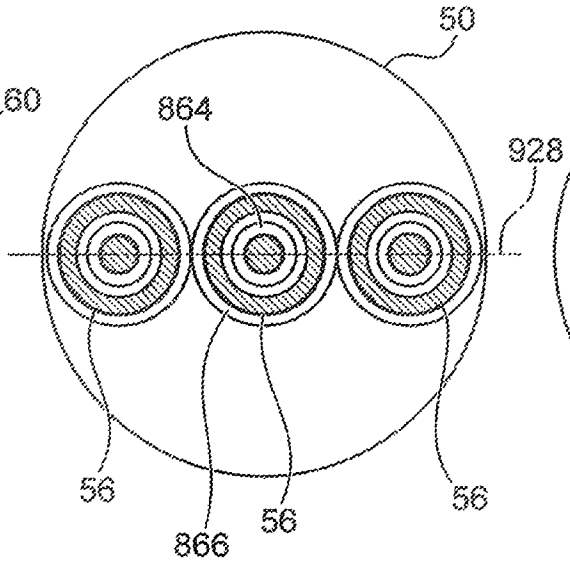
Figure 6C:
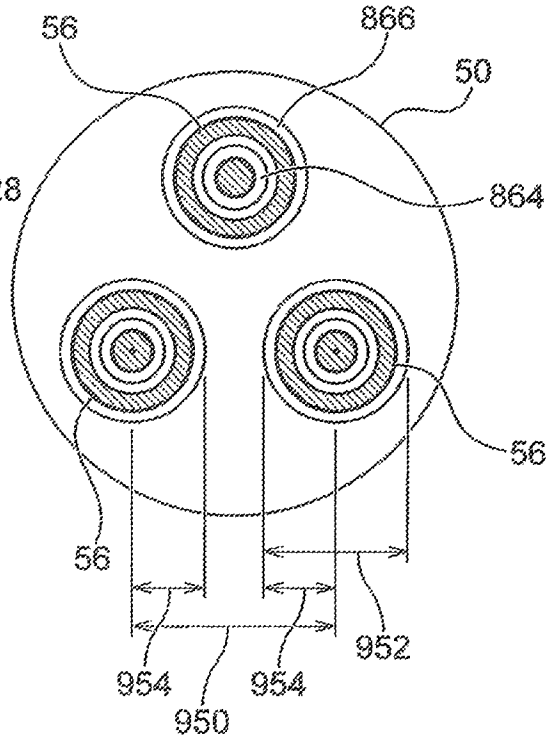

Referring to FIG. 6, the eddy current detection device 50 according to the present embodiment will be described. FIGS. 6A to 6C are plan views illustrating three types of eddy current detection devices 50. FIG. 6A illustrates an eddy current detection device 50 including four eddy current sensors 56. FIGS. 6B and 6C illustrate eddy current detection sensors 50 each including three eddy current sensors 56. The eddy current detection device 50 can be disposed near a semiconductor wafer 16 (a polishing target) on which a conductive film is formed. The eddy current detection device 50 includes the plurality of eddy current sensors 56, and the plurality of eddy current sensors 56 are disposed near to one another.

Here, disposing the eddy current detection sensors 56 near to one another means disposing the plurality of eddy current sensors 56 near to one another so that a strong magnetic field having a required predetermined strength can be generated in a desired narrow area on the semiconductor wafer 16 by the plurality of eddy current sensors 56. A specific example where the strong magnetic field having the required predetermined strength is generated in the desired narrow area will be described later by reference to FIG. 8.

In this embodiment, the plurality of eddy current sensors are disposed near to each other, and each of the plurality of eddy current sensors includes the core section, the exciting coil disposed in the core section and configured to form the eddy current, and the detection coil disposed in the core section and configured to detect the eddy current. As a result, although the eddy current is formed only one eddy current sensor in the conventional technique, since the eddy current is formed by the plurality of eddy current sensors disposed near to each other, the magnetic field formed in the polishing target becomes stronger than that formed by the conventional technique. The number of eddy current sensors to be provided only needs to be plural, and hence, two, three, four, eight, twelve, and so on eddy current sensors can be provided. In order to evaluate a film thickness highly accurately over a wide area, more than twelve eddy current sensors can also be used.

Additionally, in the embodiment, since the exciting coil and the detection coil are disposed in the same core section, the detection coil can detect the eddy current formed by the exciting coil with good efficiency. In the case where the detection coil is not disposed in the core section where the exciting coil is disposed, the detection coil cannot detect the eddy current with good efficiency. This is because an inverse magnetic field by the eddy current formed by the exciting coil becomes the greatest in the core section where the exciting coil is provided.

As a specific example where the plurality of eddy current sensors 56 are disposed near to one another, for example, in the case where the individual eddy current sensors 56 have a circular shape as illustrated in FIG. 6, an inter-center distance 950 between the adjacent eddy current sensors 56 is preferably twice the length of a diameter 952 of the eddy current sensor 56 or smaller. In the case where the individual current sensors 56 lying adjacent to one another is a square, an inter-center distance between the adjacent eddy current sensors 56 is preferably twice the length of one side of the square or smaller. In the case where the individual eddy current sensors 56 lying adjacent to one another is a rectangle, an inter-center distance between the adjacent eddy current sensors 56 is preferably twice the length of a shorter side of the rectangle or smaller. In the case where the individual current sensors 56 lying adjacent to one another is an oval, an inter-center distance between the adjacent eddy current sensors is preferably twice the length of a minor diameter of the oval or smaller.

In the case where the individual eddy current sensors 56 are a polygon, for example, in consideration of a circle or an oval that the polygon is inscribed in or circumscribed on, the eddy current sensors 56 can be disposed in the ways described above. In FIG. 6, the diameters of the adjacent eddy current sensors 56 are the same. In the case where the diameters of the adjacent eddy current sensors 56 are different, the inter-center distance 950 of the adjacent eddy current sensors 56 is preferably twice a sum of halves (that is, radii 954) of the diameters 952 of the individual eddy current sensors 56 lying adjacent to one another or smaller.

Each of the plurality of eddy current sensors 56 includes a pot core 60 (a core section), exciting coils 860, 862 disposed in the pot core 60 and configured to form an eddy current in the conductive film, and detection coils 864, 866 disposed in the pot core 60 and configured to detect the eddy current formed in the conductive film. How to dispose the exciting coils 860, 862 and the detection coils 864, 866 in the pot core 60 will be described later.

As illustrated in FIG. 6, the reason that the plurality of eddy current sensors 56 are disposed near to one another is that a stronger magnetic field is generated in a semiconductor wafer 16. The necessity of having such a stronger magnetic field will be described by reference to FIG. 7.

In one case, metal is distributed widely into the form of a plane (in bulk) on the surface of a polishing target, and in the other case, fine wirings of copper or the like exist partially on the surface of a polishing target. In the case where fine wirings exist partially on the surface of a polishing target, the density of an eddy current that flows in the polishing target is required to be greater, that is, a magnetic field formed in the polishing target by the eddy current sensor is required to be stronger than that of the case where metal is distributed widely into the form of a plane.

One aspect of the present invention provide an eddy current detection device in which a stronger magnetic field is formed in a polishing target and a polishing apparatus using the eddy current detection device.

Referring to FIG. 7, an embodiment will be described in which the strength of a magnetic field generated by the exciting oil 860 and/or the exciting coil 862 needs to be increased when the conductivity of the semiconductor wafer 16 changes. Hereinafter, the embodiment in which the strength of the magnetic field generated by the exciting coil 860 and the exciting coil 862 is increased will be described. However, the strength of a magnetic field generated by only one of the exciting coil 860 and the exciting coil 862 may be increased.

Figure 7A:
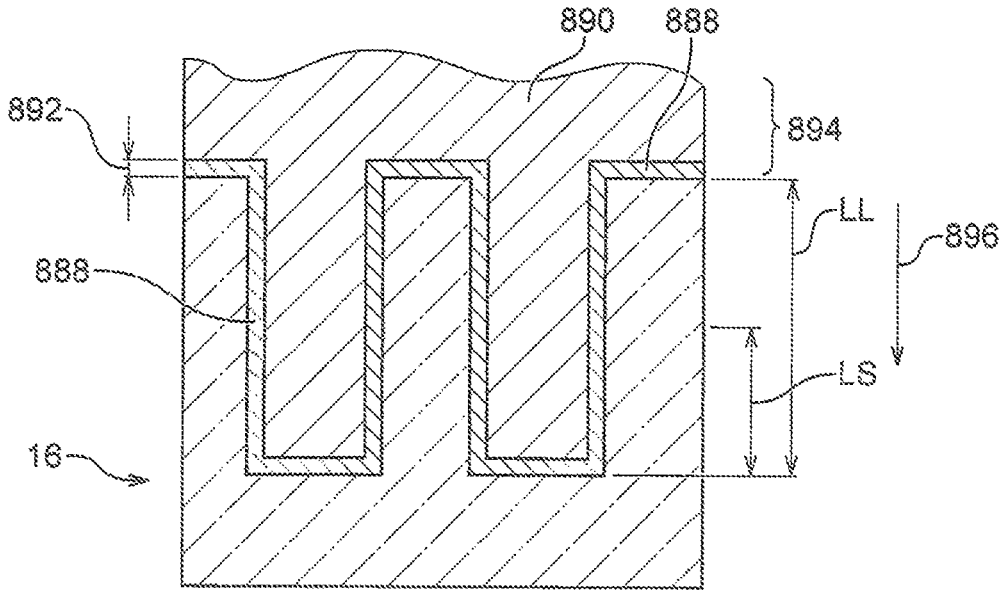
FIGS. 7A to 7C are diagrams for illustrating an embodiment in which a strength of a magnetic field generated by an exciting coil is changed when a conductivity of a semiconductor wafer is changed.
Figure 7B:
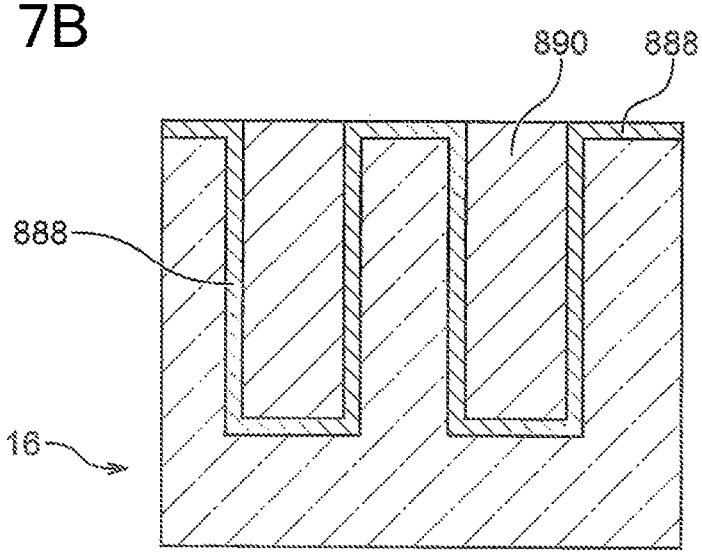
Figure 7C:
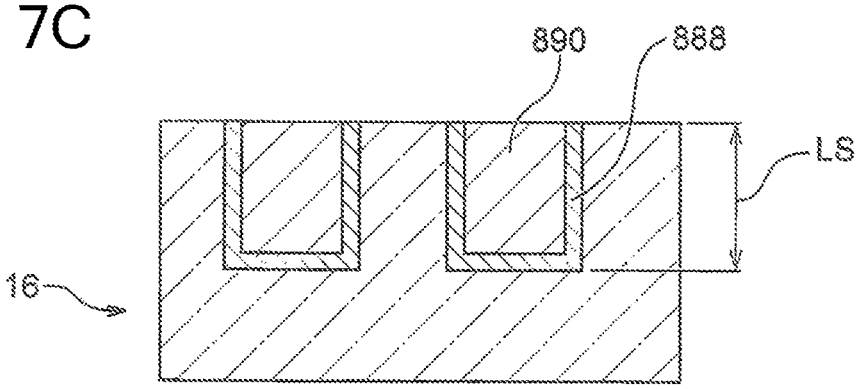

In FIG. 7, an insulation layer 888 (a barrier) is formed on the semiconductor wafer 16, and a conductive layer 890 of copper or the like is formed on the insulation layer 888. Polishing is performed from a state in FIG. 7A to a state in FIG. 7C through a state in FIG. 7B. The conductive layer 890 is used as, for example, a wiring.

In the state in FIG. 7A, since the conductive layer 890 exists on the whole of a front surface of the semiconductor wafer 16, the conductive layer 890 generates a great eddy current. A film that covers most of the surface like the conductive layer 890 illustrated in FIG. 7A is called a bulk. In the state in FIG. 7C, since the conductive layer 890 exists only on a small portion of the semiconductor wafer 16, the conductive layer 890 generates a small eddy current. The strength of a magnetic field that the exciting coils 860, 862 generate may be small from the state in FIG. 7A to the state in FIG. 7B. The strength of the magnetic field that the exciting coils 860, 862 generate needs to be great when the state in FIG. 7B is reached. This is because the conductive of the semiconductor wafer 16 changes when the state in FIG. 7B is reached.

The timing at which the strength of the magnetic field that the exciting coils 860, 862 generate is changed when the conductivity of the semiconductor wafer 16 changes may not be when the state in FIG. 7B is reached but may be when polishing a portion 892 of the insulation layer 888 illustrated in FIG. 7A is completed.

In order to increase the strength of the magnetic field that the exciting coils 860, 862 generate, a current caused to flow to the exciting coils 860, 862 is increased or a voltage applied to the exciting coils 860, 862 is increased. As another method of increasing the strength of the magnetic field, a state where only one of the exciting coil 860 and the exciting coil 862 is used may be changed to the state where both the exciting coil 860 and the exciting coil 862 are used.

Incidentally, in the state in FIG. 7C, there may be a case where the conductive layer 890 exists only at a small portion of the semiconductor wafer 16 relative to an outside diametric size of the exciting coil. At this time, only changing the strength of the magnetic field that the exciting coil 860 and/or the exciting coil 862 generates when the conductivity of the semiconductor wafer 16 changes may be insufficient. As this occurs, the eddy current detection device 50 including the plurality of eddy current sensors as in the present embodiment becomes necessary. This will be described by reference to FIG. 8.

Figure 8:
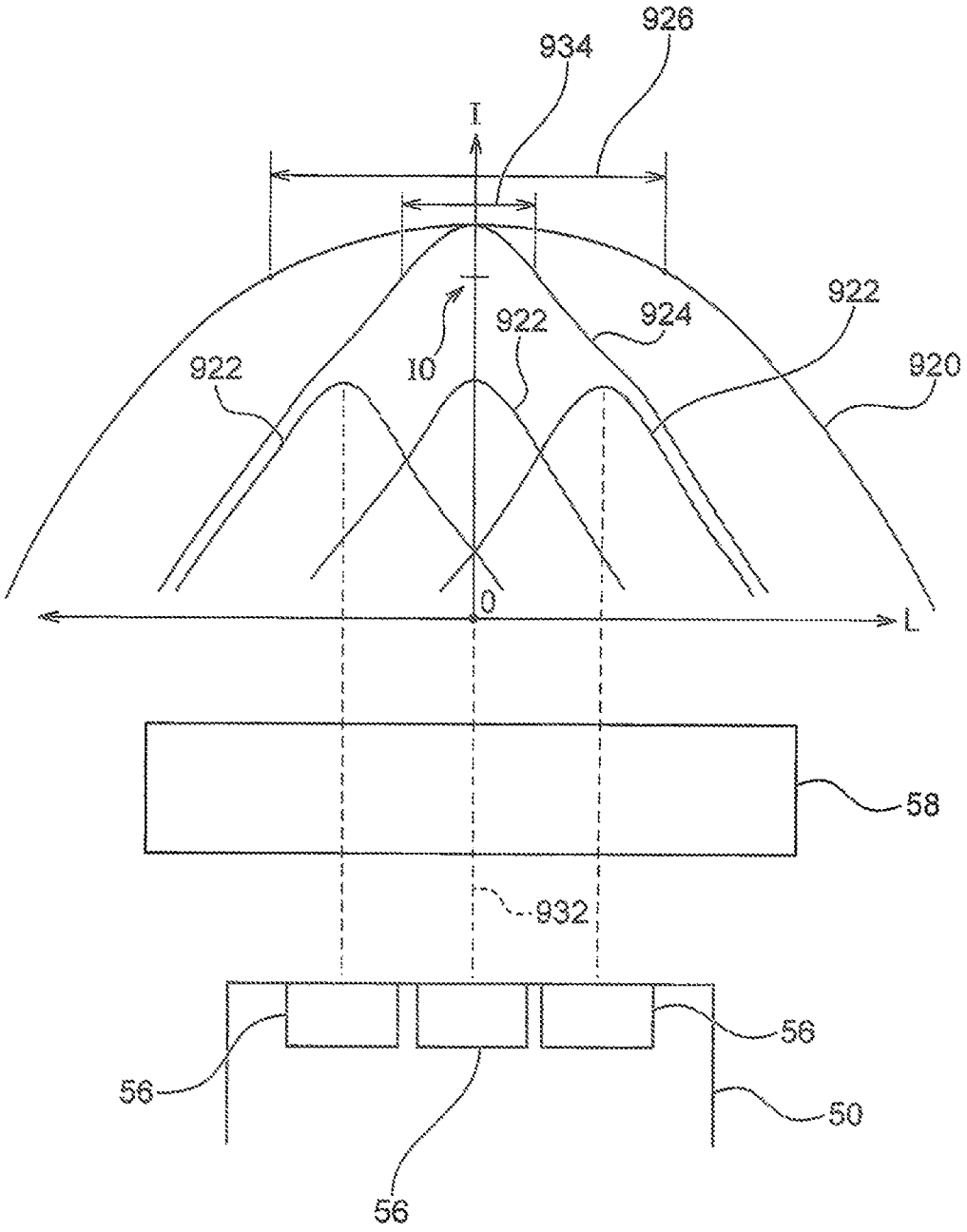
FIG. 8 is a diagram illustrating a magnetic filed formed by an exciting coil having a large outside diametric size and a magnetic field formed by an exciting coil having a small outside diametric size in comparison.

FIG. 8 is a diagram illustrating a magnetic field formed by an exciting coil of a great outside diametric size and a magnetic field formed by an exciting coil of a small outside diametric size in comparison. FIG. 8 illustrates a magnetic field 920 that is generated in the conductive layer 890 on the surface of the semiconductor layer 16 when there is one eddy current sensor 58 including an exciting coil having a great outside diametric size as in a conventional example and a magnetic field 924 that is generated in the conductive layer 890 on the surface of the semiconductor wafer 16 when there are three eddy current sensors 56 each including an exciting coil of a small outside diametric size (for example, a diameter of 5 mm) (corresponding to the state in FIG. 6B). In the figure, an axis of abscissas denotes a distance (mm) from a center of the exciting coil of the eddy current sensor 58, and an axis of ordinates denotes strengths ($Wb/m^2$) of magnetic fields generated by the exciting coils. The eddy current sensor 58 is illustrated in a side view in FIG. 8, and only the external shape of the exciting coil 862 is illustrated. The eddy current detection device 50 is illustrated by a cross section taken along a center line 928 illustrated in FIG. 6B.

As to the size of the eddy current sensors 56, in many cases, a sensor having a diameter of about 15 mm or smaller is regarded as a sensor of a small size, and a sensor having a diameter of greater than 15 mm is regarded as a sensor of a great size. Although the size is expressed by the diameter of an external shape (an outer circumference) of the eddy current sensor 56 in many cases, the size may be expressed by a representative length of the eddy current sensors 56. For sensors of a small size, sensors of a diameter ranging from 1 to 15 mm can be used in accordance with process applications. Sensors of a diameter of smaller than 1 mm can be fabricated using the micro-fabrication technique.

Superposing magnetic fields 922 generated individually by the three eddy current sensors 56 on one another results in the magnetic field 924. The magnetic field 920 and the magnetic field 924 are magnetic fields that are generated in the conductive layer 890 lying on the surface of the semiconductor wafer 16 that corresponds to the center line 928 illustrated in FIG. 6B. The magnetic field 920 and the magnetic field 924 are illustrated based on the understanding that a distance between the conductive layer 890 and the eddy current sensor 56 and a distance between the conductive layer 890 and the eddy current sensor 58 are the same.

In FIG. 8, a center line 932 is considered as passing through the center of the eddy current sensor 58 and the center of the eddy current detection device 50.

The magnetic field 920 has a wide range of magnetic field, in the magnetic field 924, a narrow range of magnetic field is generated. In comparison with the outside diametric size of the large eddy current sensor 58 (for example, with a diameter of 20 mm), when an area occupied by the metal in the conductive layer 890 is not the bulk, for example, when the area occupied by the metal is only 50% (when a few metallic areas, each being a 5-mm square, exist in a 20-mm square), it may be difficult for the eddy current sensor 58 to detect a change in film thickness. At this time, in comparison with the eddy current sensor 58, the eddy current detection device 50 including the small eddy current sensors 56 having the narrow range of magnetic field has the following advantages.

In the small eddy current sensor 56 (whose diameter is, for example, 5 mm) having the narrow range of magnetic field, in the area described above, since the area occupied by the metal in the range of the eddy current sensor 56 (whose diameter is 5 mm) becomes, for example, 100%, the eddy current sensor 56 can detect a change in thickness of the film. However, with one small eddy current sensor 56 in which the range of the magnetic field 922 is narrow, when comparing with the magnetic field 920 generated by the eddy current sensor 58, as illustrated in FIG. 8, an eddy current generated by the magnetic field 922 becomes weak, and a reaching distance of the magnetic field 922 becomes small. As a result, an eddy current generated by the magnetic field 922 becomes weak, leading to another problem that a change in thickness of the film cannot be detected by the eddy current sensor 56.

With the present embodiment, the problem described above is solved by installing the plurality of eddy current sensors 56 in the same eddy current detection device 50. According to the present embodiment, (1) a spot is made smaller by a coil that is smaller than that of the eddy current sensor 58, and (2) the magnetic field can be made stronger by a plurality of small coils. The magnetic field 924 that is generated by the plurality of eddy current sensors 56 illustrated in FIG. 8 (that is, the magnetic field generated by the eddy current detection device 50) has the following advantages.

When compared with the magnetic field 920, in the magnetic field 924, an area where the strength of the magnetic field is great is narrow. That is, an area 934 of the magnetic field 924 where the strength is greater than a predetermined strength 10 is narrower than an area 926 of the magnetic field 920 where the strength is greater than the predetermined strength 10. Then, the strength of the magnetic field of the area 926 is almost the same as the strength of the magnetic field of the area 934. Thus, as described above, in the case where there exist a few metallic areas of a 5-mm square in a 20-mm square, these metallic areas of a 5-mm square cannot be detected by the magnetic field 920 but can be detected by the magnetic field 924.

In the present embodiment, although the eddy current sensor 56 is described as being small, the eddy current sensor 56 can be said to be so small in a relative comparison with the eddy current sensor 58 that is greater in size. When the eddy current sensor 58 is said to cause a problem due to its great size, that is not because the area occupied by the metal in the conductive layer 890 is considered to be the bulk when compared with the size of the eddy current sensor 56 but because the area occupied by the metal in the conductive area 890 is considered to be the bulk when compared with the size of the eddy current sensor 58. In the case where the area occupied by the metal in the conductive layer 890 is reduced further, the area occupied by the metal in the conductive layer 890 is not considered to be the bulk when compared with the size of the small eddy current sensor 56, and hence, an eddy current sensor 56 that is smaller than the eddy current sensor 56 is considered to be necessary.

According to the eddy current detection device 50, there are provided such advantages that the magnetic field that is generated by the exciting coils 860, 862 towards the semiconductor wafer 16 can be increased, increasing the density of the eddy current (1), and that the detection coils 864, 866 can obtain more a demagnetizing field (an interlinking magnetic flux) that is generated by the eddy current (2), and in addition, there is also provided an advantage that since the pot core 60 has the relatively small diameter, other influence (external influence) than the film on the surface of the semiconductor wafer 16 can be made smaller. This will be described in greater detail later by reference to FIG. 16.

Although the conductive layer 890 illustrated in FIG. 7C is, for example, a Cu wiring, the present invention is not limited to detection of a wiring, and when metal is provided in a narrow area, the sensitivity with which the metal is detected can be improved.

Next, the eddy current detection device 50 including the polishing apparatus according to the present invention will be described in greater detail by reference to the drawings. As illustrated in FIGS. 6A, 6C, the plurality of eddy current sensors 56 are disposed, to form a regular polygon, at vertices of the regular polygon on a surface (a top surface) of the polishing table 30A. A portion (an upper portion) of the eddy current sensor 56 may be disposed in an interior of the polishing pad 10. In FIG. 6A, the eddy current sensors 56 are disposed at vertices of a square. In FIG. 6C, the eddy current sensors 56 are disposed at vertices of a triangle. In FIG. 6B, the plurality of eddy current sensors 56 are disposed, to form a straight line, on the center line 928. The polygon preferably takes the shape of a regular polygon so that a magnetic field generated by the eddy current detection device takes a symmetrical shape. The regular polygon means a polygon in which lengths of all sides are equal and degrees of all internal angles are equal. A polygon having a smallest number of sides is a triangle.

The plurality of eddy current sensors 56 may be disposed along an inner circumference of the eddy current detection device 50. For example, when the external shape of the eddy current detection device 50 is a circle, the plurality of eddy current sensors 56 may be disposed on a circumference along the inner circumference of the eddy current detection device 50. A film thickness may be measured by using only part of the plurality of eddy current sensors 56 that is included in the eddy current detection device 50. For example, nine eddy current sensors 56 are disposed by disposing three eddy current sensors 56 along each of three rows in an eddy current detection device 50 having a polygonal external shape. That is, the total of nine eddy current sensors 56 arranged in three rows of three eddy current sensors 56 are provided in an interior of the eddy current detection device 50. A film thickness may be measured by using only part or all of the nine eddy current sensors 56. Which of the nine eddy current sensors 56 is or are used is determined in accordance with a fine circuit on a semiconductor wafer 16, which is a measuring target.

In FIG. 5, although one eddy current detection device 50 is provided in the interior of the polishing table 30A, a plurality of eddy current detection devices 50 may be provided in the interior of the polishing table 30A. As an arrangement of the eddy current detection devices 50 in the interior of the polishing table 30A, for example, the plurality of eddy current detection devices 50 can be disposed on a circumference of the polishing table 30A having a circular shape.

The size of the area 934 illustrated in FIG. 8 will be compared among those that would be formed by eddy current sensors 56 of the eddy current detection device 50 illustrated in FIGS. 6A, 6B and 6C. In FIGS. 6A, 6B and 6C, in the case where the eddy current sensors 56 are made up of the same sensor, an area 934 generated by the eddy current detection sensor 50 illustrated in FIG. 6B is wider than areas 934 generated by the eddy current detection devices illustrated in FIGS. 6A and 6C. Consequently, when the magnetic field is desired to be concentrated to a thinner portion, the eddy current sensors 56 are preferably arranged as done in the eddy current detection devices 50 illustrated in FIGS. 6A and 6C.

In FIG. 6, the external shape (the housing) of the eddy current detection device 50 is cylindrical, and the material of the housing is resin or metal. The interior of the eddy current detection device 50 is filled with an insulation material such as an epoxy resin in such a manner as to surround circumferences 930 of the eddy current sensors 56, whereby the eddy current sensors 56 are fixed in place in the eddy current detection device 50. The fixing method of the eddy current sensors 56 is not limited to the method of fixing them by the insulation material, and hence, the eddy current sensors 56 may be fixed in place within the cylinder by methods of using a fixing member, welding, and bonding, or a combination of these methods. The external shape of the eddy current detection device 50 is not limited to the cylindrical shape but may be a prism-like shape.

Next, the eddy current sensor 56 will be described. A core of the eddy current sensor 56 can have an arbitrary shape. That is, the core can have a cylindrical shape like that of a solenoid coil, a pod core shape, or E-like shape or the like. In the cylindrical shape, the pod core shape, and E-like shape, since the pod core shape is preferable because a thin magnetic flux can be generated by the pod core shape. In the case of the pod core shape, the core section normally includes a bottom surface portion, a magnetic center portion provided at a center of the bottom surface portion, and a circumferential portion provided on a circumference of the bottom surface portion. The exciting coils and the detection coils can be disposed at the magnetic center portion.

Figure 9:
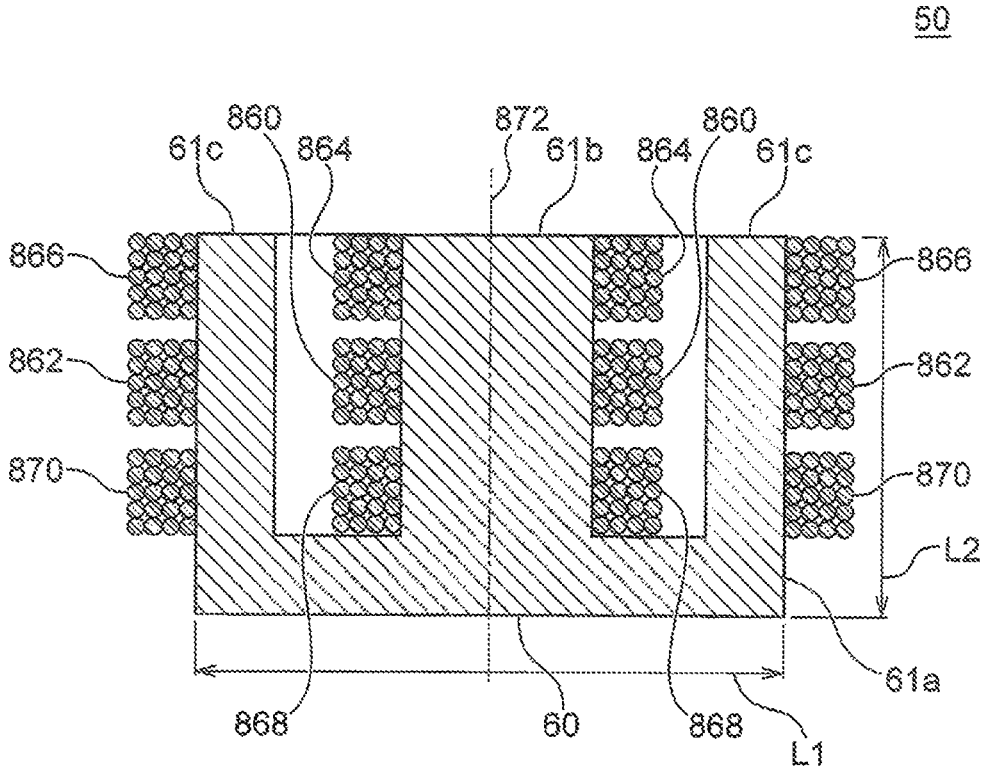
FIG. 9 is a schematic diagram illustrating an example of a configuration of an eddy current sensor according to the embodiment of the present invention.
Figure 10:
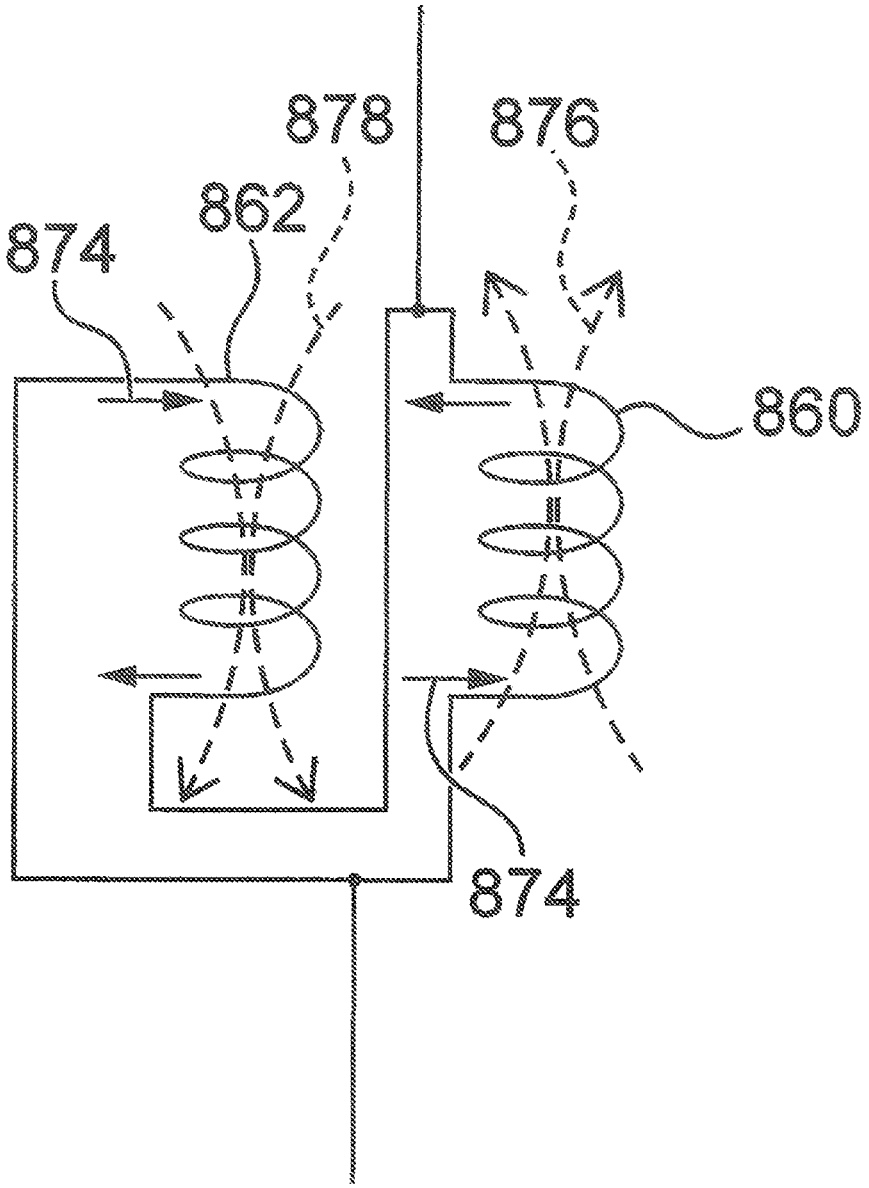
FIG. 10 is a schematic diagram illustrating an example of a connection of exciting coils in the eddy current sensor.

The exciting coils and the detection coils can also be disposed at the circumferential portion, in addition to the magnetic center portion. The circumferential portion constitutes a circumferential wall portion that is provided along the circumference of the bottom surface portion in such a manner as to surround the magnetic center portion. FIGS. 9 and 10 are schematic diagrams illustrating a configuration example of the eddy current sensor 56 of the present embodiment. The eddy current sensor 56 disposed near a substrate on which a conductive film is formed is made up of the pod core 60 and the six coils 860, 862, 864, 866, 868, and 870. The pod core 60, which is a magnetic element, includes a bottom surface portion 61*a* (a bottom magnetic element), a magnetic center portion 61*b* (a central magnetic element) that is provided at a center of the bottom surface portion 61*a*, and a circumferential wall portion 61*c* (a circumferential magnetic element) that is provided at a circumferential portion of the bottom surface portion 61*a*. The circumferential wall portion 61*c* constitutes a wall portion provided at the circumferential portion of the bottom surface portion 61*a* so as to surround the magnetic center portion 61*b*. In the present embodiment, the bottom surface portion 61*a* has a circular disk shape, the magnetic center portion 61*b* has a solid cylindrical shape, and the circumferential wall portion 61*c* has a cylindrical shape that surrounds the bottom surface portion 61*a*. According to this embodiment, the eddy current that can be formed by the exciting coil can be concentrated on to a narrow area. The magnetic filed formed on the polishing target becomes stronger, compared with a case where no circumferential wall portion is provided on the circumference of the bottom surface portion.

In the six coils 860, 862, 864, 866, 868, 870, the central coils 860, 862 are exciting coils that are connected together by an alternating-current signal source 52, which will be described later. These exciting coils 860, 862 form an eddy current in a metallic film (or a conductive film) mf on a semiconductor wafer 16 disposed near to the exciting coils 860, 862 by a magnetic field that is formed by a voltage supplied by the alternating-current signal source 52. The detection coils 864, 866 are disposed on metallic film sides of the exciting coils 860, 862, respectively, to detect a magnetic field that is generated by the eddy current formed in the metallic film. Dummy coils 868, 870 are disposed on opposite sides of the exciting coils 860, 862, respectively, to the sides where the detection coils 864, 866 are disposed. One coil may function as an exciting coil and a detection coil.

The exciting coil 860 is disposed on an outer circumference of the magnetic center portion 61*b* and is an internal coil that can generate a magnetic field, forming an eddy current in the conductive film. The exciting coil 862 is disposed on an outer circumference of the circumferential wall portion 61*c* and is an external coil that can generate a magnetic field, forming an eddy current in the conductive film. The detection coil 864 is disposed on the circumference of the magnetic center portion 61*b* and can detect a magnetic field, detecting an eddy current formed in the conductive film. The detection coil 866 is disposed on the outer circumference of the circumferential wall portion 61*c* and can detect a magnetic field, detecting an eddy current formed in the conductive film.

The eddy current sensor includes the dummy coils 868, 870 configured to detect an eddy current formed in the conductive film. The dummy coil 868 is disposed on the outer circumference of the magnetic center portion 61*b* and can detect a magnetic field. The dummy coil 870 is disposed on the outer circumference of the circumferential wall portion 61*c* and can detect a magnetic field. In the present embodiment, although the detection coils and the dummy coils are disposed on the outer circumference of the magnetic center portion 61*b* and the outer circumference of the circumferential wall portion 61*c*, the detection coil and the dummy coil may be disposed only one of the outer circumference of the magnetic center portion 61*b* and the outer circumference of the circumferential wall portion 61*c*.

An axial direction of the magnetic center portion 61*b* intersects the conductive film on the substrate at right angles, and the detection coils 864, 866, the exciting coils 860, 862, and the dummy coils 868, 870 are disposed in different positions in the axial direction of the magnetic center portion 61*b*. The detection coils 864, 866, the exciting coils 860, 862, and the dummy coils 868, 870 are disposed sequentially from a position lying nearer to the conductive film on the substrate towards a position lying farther from the conductive film on the substrate in the axial direction of the magnetic center portion 61*b* in that order. Lead wires (not shown) are drawn out from the detection coils 864, 866, the exciting coils 860, 862, and the dummy coils 868, 870 for connection with exteriors of the eddy current sensor.

FIG. 9 is a cross-sectional view taken along a plane passing through a center axis 872 of the magnetic center portion 61*b*. The pod core 60, which is the magnetic element, includes the bottom surface portion 61*a* having a disk shape, the magnetic center portion 61*b* provided at the center of the bottom surface portion 61*a* and having a cylindrical shape, and the circumferential wall portion 61*c* provided on the circumference of the bottom surface portion 61*a* and having a cylindrical shape. As an example of dimensions of the pot core 60, a diameter L1 of the bottom surface portion 61*a* is in a range from about 1 cm to 5 cm, and a height L2 of the eddy current sensor 56 is in a range of about 1 cm to 5 cm. An outside diameter of the circumferential wall portion 61*c* has the same size in a height direction, and hence, the pot core 60 defines the cylindrical shape in the height direction. However, the pot core 60 may have a shape decreasing its diameter towards a distal end (a tapered shape) in a direction in which the pot core 60 extends forwards from the bottom surface portion 61*a*.

A conductor used for the detection coils 864, 866, the exciting coils 860, 862, and the dummy coils 868, 870 is a copper wire, a manganin wire, or a nichrome wire. A change in electric resistance or the like by temperature change is reduced by using a manganin wire or a nichrome wire, whereby the temperature properties are improved.

In the present embodiment, since the exciting coils 860, 862 are formed by winding a wire material around an outer side of the magnetic center portion 61*b*, which is made of a magnetic element such as ferrite, and an outer side of the circumferential wall portion 61*c*, the density of an eddy current flowing to a measuring target can be enhanced. In addition, since the detection coils 864, 866 are also formed on the outer side of the magnetic center portion 61*b* and the outer side of the circumferential wall portion 61*c*, the detection coils 864, 866 can collect a demagnetizing field (an interlinking magnetic flux) generated with good efficiency. In the case where the exciting coil and the detection coil are disposed at the circumferential portion in addition to the magnetic center portion, compared with the case where the exciting coil and the detection coil are disposed only at the magnetic center portion, the eddy current that can be formed by the exciting coil can be concentrated on to a narrow area, whereby the magnetic field formed on the polishing target becomes stronger.

In order to increase the density of the eddy current flowing to the measuring target, in the present embodiment, further, the exciting coil 860 and the exciting coil 862 are connected parallel as illustrated in FIG. 10. That is, the inner coil and the outer coil (that is, the exciting coil 860 and the exciting coil 862) are electrically connected parallel to each other. The reason that the exciting coil 860 and the exciting coil 862 are connected parallel to each other is as follows. A voltage that can be applied to the exciting coil 860 and the exciting coil 862 is increased more than when the exciting coil 860 and the exciting coil 862 are connected in series, whereby a more current flow to the exciting coil 860 and the exciting coil 862. As a result, a greater magnetic field is generated. On the other hand, when the exciting coil 860 and the exciting coil 862 are connected in series with each other, the inductance of the circuit is increased, whereby the frequency of the circuit is reduced. It becomes difficult for a required high frequency to be applied to the exciting coil 860 and the exciting coil 862. Arrows 874 denote directions of currents flowing to the exciting coil 860 and the exciting coil 862.

Figure 11:
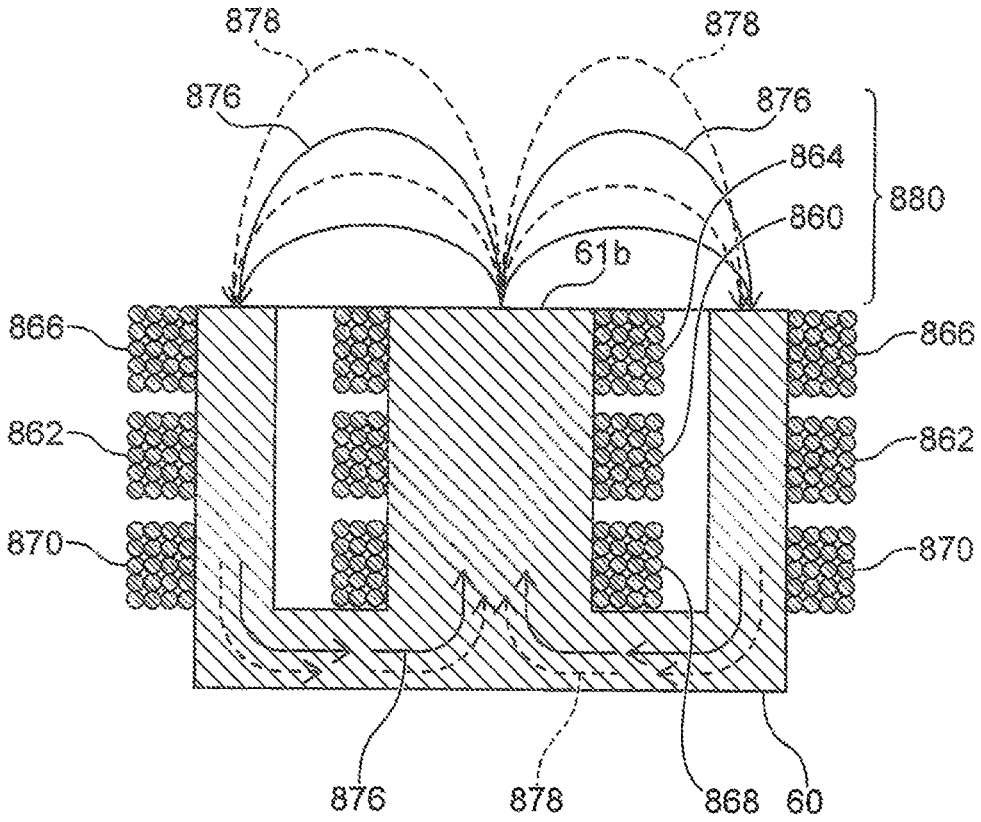
FIG. 11 is a diagram illustrating a magnetic field formed by the eddy current sensor.

As illustrated in FIG. 10, the exciting coil 860 and the exciting coil 862 are preferably connected in such a manner that the magnetic fields of the exciting coil 860 and the exciting coil 862 have the same direction. That is, the current is caused to flow in different directions in the exciting coil 860 and the exciting coil 862. A magnetic field 876 is a magnetic field that the inner exciting coil 860 generates, and a magnetic field 878 is a magnetic field that the outer exciting coil 862 generates. As illustrated in FIG. 11, the directions of the magnetic fields of the exciting coil 860 and the exciting coil 862 are the same. That is, the direction of the magnetic field that the inner coil generates in the magnetic center portion 61*b* and the direction of the magnetic field that the outer coil generates in the magnetic center portion 61*b* are the same.

Since the magnetic field 876 and the magnetic field 878 that are shown in an area 880 are directed in the same direction, the two magnetic fields are added to each other, resulting in a greater magnetic field. Compared with the conventional case where only the magnetic field 876 that the exciting coil 860 generates exists, in the present embodiment, the magnetic field is increased by such an extent that the magnetic field 878 is generated by the exciting coil 862.

Figure 12A:
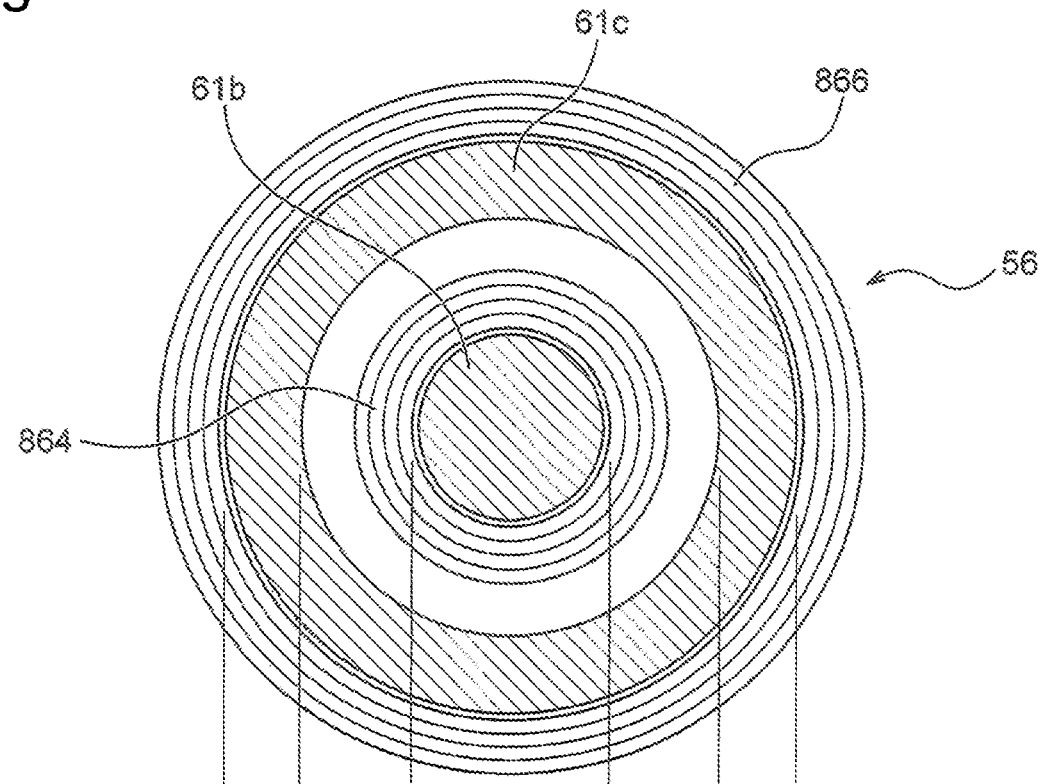
FIGS. 12A and 12B are diagrams illustrating a magnetic filed that is formed eventually by a magnetic field formed by an internal coil and a magnetic field formed by an external coil.
Figure 12B:
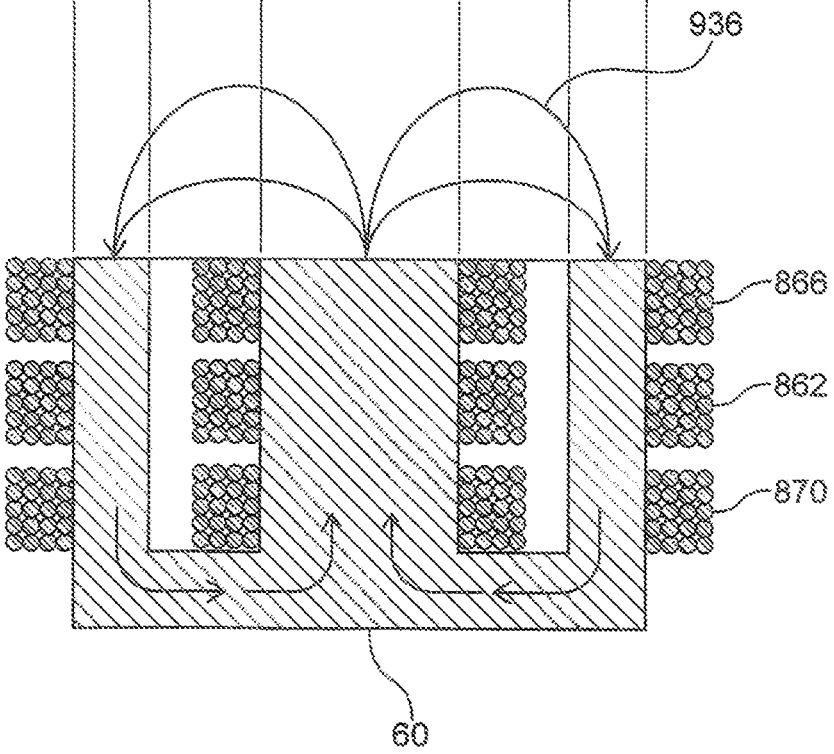

FIG. 12 illustrates a magnetic field 936 that is eventually generated from the magnetic field 876 and the magnetic field 878. FIG. 12A is a plan view of the eddy current sensor 56, and FIG. 12B is a cross-sectional view taken along a plane that passes through a center axis 872 of the magnetic center portion 61*b*. In the present embodiment, an outer most layer of the eddy current sensor 56 constitutes a cylindrical housing. The material of the housing is metal or resin. An epoxy resin or the like, which constitutes an insulation material, is filled between the outermost layer and the exciting coil 862, the detection coil 866, and the dummy coil 870. An epoxy resin or the like, which constitutes an insulation material, is filled between an inner wall of the circumferential wall portion 61*c* and the exciting coil 860, the detection coil 864, and the dummy coil 868. The pot core 60 is fixed to the housing with a fixture or an adhesive or the like.

Figure 13A:
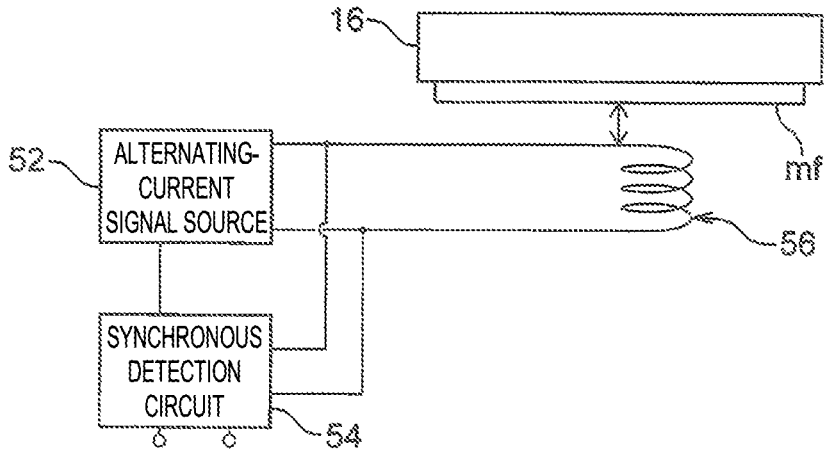
Figure 13B:
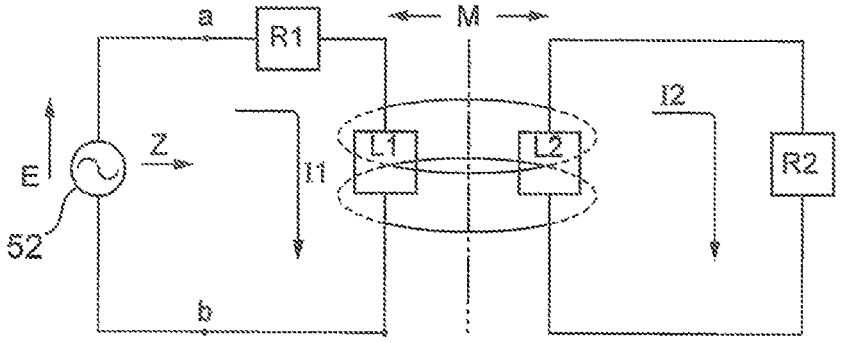

Next, an electric configuration of the eddy current sensor 56 will be described. FIG. 13 is a diagram illustrating an electric configuration of the eddy current sensor 56. FIG. 13A is a block diagram illustrating the configuration of the eddy current sensor 56, and FIG. 13B is an equivalent circuit diagram of the eddy current sensor 56. The eddy current detection device 50 includes the plurality of eddy current sensors 56, and these eddy current sensors 56 are preferably electrically connected parallel to one another. Alternatively, the eddy current sensors 56 may be connected independently to a signal source to add an output obtained from the detection coils by software by making use of an analog circuit, a digital circuit, or an AD conversion circuit.

There may be situations where the output characteristics of the plurality of eddy current sensors 56 within one eddy current detection device 50 vary. When the variation in the output characteristics needs to be reduced, one or more of a plurality of methods below can be used to deal with the required reduction. i) Output characteristics of a plurality of eddy current sensors 56 are individually measured before the plurality of eddy current sensors 56 are built into one eddy current detection device 50, and a plurality of eddy current sensors 56 having similar output characteristics are selected to be built into one eddy current detection device 50.

ii) A control circuit or a control program is provided to control individually output characteristics of a plurality of eddy current sensors 56 of one eddy current detection device 50 so that the output characteristics become similar to one another. The control circuit or the control program is a circuit or a program for measuring output characteristics or the like of the individual eddy current sensors 56 in advance and changing the output characteristics or the like of the individual eddy current sensors 56 based on the results of the measurements. Changing the output characteristic of the eddy current sensor 56 may include, for example, setting a weighted output for the eddy current sensor 56 in question.

The specific contents (for example, setting a weighted output) of i) and ii) may be changed in accordance with the characteristics (for example, a material, an electric characteristic of a circuit formed, and the like) of the semiconductor wafer 16, which is a measuring target. That is, there may be situations where when the characteristics of the semiconductor wafer 16, which is the measuring target, are changed, the specific contents of the methods of i) and ii) are desirably changed accordingly.

As illustrated in FIG. 13A, the eddy current sensor 56 is disposed near to the metallic film (or the conductive film) mf, which constitutes a detection target, and the alternating-current signal source 52 is connected to the coils of the eddy current sensor 56. Here, the metallic film (or the conductive film) mf, which constitutes the detection target, is a thin film of Cu, Al, Au, W, or the like that is formed, for example, on the semiconductor wafer 16. The eddy current sensor 56 is disposed on the order of 1.0 to 4.0 mm near to the metallic film (or the conductive film) constituting the detection target.

The eddy current sensor 56 is of a frequency type or an impedance type. In the eddy current sensor 56 of the frequency type, an oscillation frequency changes when an eddy current is generated in the metallic film (or the conductive film), whereby the metallic film (or the conductive film) is detected from the change in frequency. In the eddy current sensor 56 of the impedance type, an impedance changes when an eddy current is generated in the metallic film (or the conductive film), whereby the metallic film (or the conductive film) is detected from the change in impedance. That is, in the eddy current sensor 56 of the frequency type, in the equivalent circuit illustrated in FIG. 13B, an impedance Z changes as an eddy current I2 changes, and the oscillation frequency of the signal source (a variable-frequency oscillator) 52 changes. Then, this change in oscillation frequency is detected by a detection circuit 54, whereby a change in the metallic film (or the conductive film) can be detected. In the eddy current sensor 56 of the impedance type, in the equivalent circuit illustrated in FIG. 13B, the impedance Z changes as the eddy current I2 changes, and when the impedance Z seen from the signal source (a fixed-frequency oscillator) 52 changes, this change in impedance Z is detected by the detection circuit 54, whereby the change in the metallic film (or the conductive film) can be detected.

In the eddy current sensor of the impedance type, signal outputs X, Y, a phase, and a combined impedance Z are fetched as will be described later. Measurement information on the metallic film (or the conductive film) of Cu, Al, Au, or W is obtained from a frequency F, or impedances X, Y, and the like. The eddy current sensor 56 can be incorporated in a position lying in the vicinity of the surface in the interior of the polishing table 30A and is positioned in such a manner as to face the semiconductor wafer 16, which is the polishing target, via the polishing pad 10 as illustrated in FIG. 4, whereby the eddy current sensor 56 can detect a change in the metallic film (or the conductive film) from the eddy current flowing to the metallic film (or the conductive film) on the semiconductor wafer 16.

A single wave, a mixed wave, an AM modulating wave, an FM modulating wave, a sweep output of a function generator, or a plurality of oscillation frequency sources can be used for the frequency of the eddy current sensor, and an oscillation frequency or a modulation method with good sensitivity is preferably selected to match the type of the metallic film.

Hereinafter, the eddy current sensor 56 of the impedance type will be described specifically. The alternating-current signal source 52 is an oscillator of a fixed frequency of the order of 2 to 30 MHz, and for example, a crystal oscillator is used for the eddy current sensor 56. A current I1 is caused to flow to the eddy current sensor 56 by an alternating-current voltage that is supplied by the alternating-current signal source 52. When the current flows to the eddy current sensor 56 disposed near the metallic film (or the conductive film) mf, a resultant magnetic flux is interlinked with the metallic film (or the conductive film) mf, whereby a mutual inductance M is formed therebetween, and an eddy current I2 flows in the metallic film (or the conductive film) mf. Here, R1 denotes an equivalent resistance on a primary side that includes the eddy current sensor, and L1 denotes an self-inductance of the primary side that includes the eddy current sensor. On the metallic film (or the conductive film) mf side, R2 denotes an equivalent resistance corresponding to an eddy current loss, and L2 denotes a self-inductance thereof. The impedance Z seen from terminals a, b of the alternating-current signal source 52 toward an eddy current sensor side changes based on the magnitude of the eddy current loss formed in the metallic film (or the conductive film) mf.

Figure 14A:
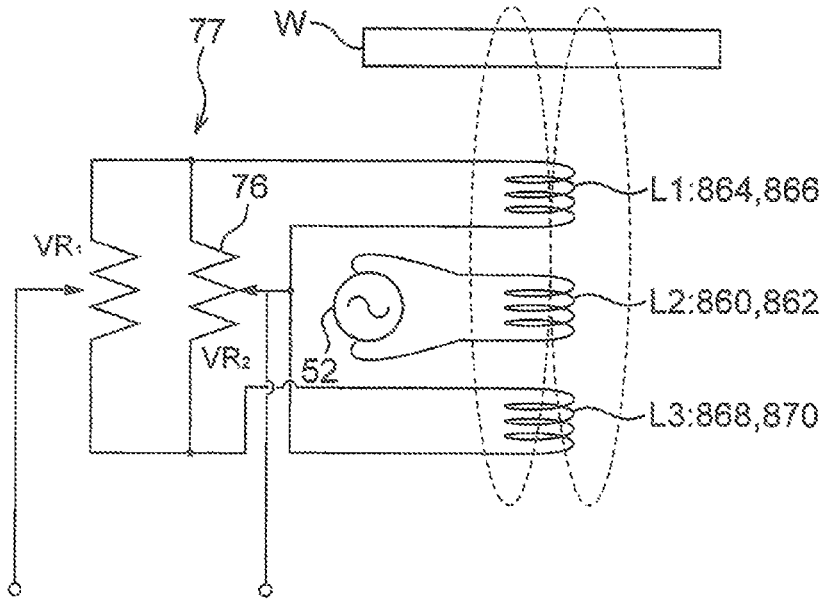
FIGS. 14A, 14B and 14C are schematic diagrams illustrating examples of connection of coils in the eddy current sensor.
Figure 14B:
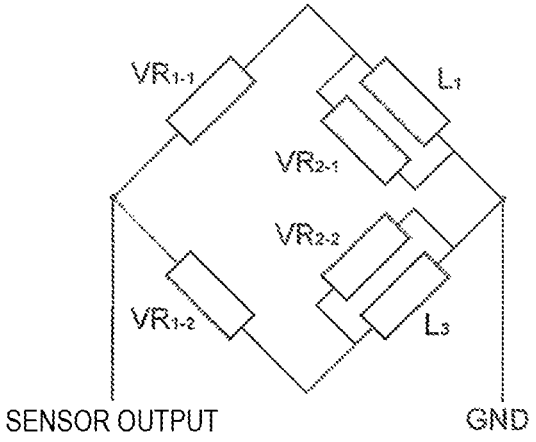

FIG. 14 is a schematic diagram illustrating a connection example of the coils of the eddy current sensor. As illustrated in FIG. 14A, the detection coils 864, 866 are connected with the dummy coils 868, 870 in an opposite phase to each other. The detection coil 864 and the detection coil 866 are connected in series with each other. The dummy coil 868 and the dummy coil 870 are connected in series with each other. In FIG. 14A, the exciting coils 860, 862, the detection coils 864, 866, and the dummy coils 868, 870 are each illustrated as being one coil.

The detection coils 864, 866 and the dummy coils 868, 870 form the series circuit in the opposite phase as described above and are connected to a bridge circuit 77 that includes a variable resistance 76 at ends thereof. The exciting coils 860, 862 are connected to the alternating-current signal source 52 and form an eddy current in the metallic film (or the conductive film) mf that is disposed near the exciting coils 860, 862 by generating an alternating magnetic flux. An output voltage of the series circuit made up of the detection coils 864, 866 and the dummy coils 868, 870 can be controlled so as to become zero when no metallic film (or no conductive film) exists by controlling a resistance value of the variable resistance 76. Signals of $L_1$, $L_3$ are controlled so as to have the same phase by the variable resistance 76 ($VR_1$, $VR_2$) that is connected parallel to the detection coils 864, 866 and the dummy coils 868, 870. That is, the variable resistances $VR_1$ ($=VR_{1-1}+VR_{1-2}$) and $VR_2$ ($=VR_{2-1}+VR_{2-2}$) are controlled so that the following expression (1) holds in an equivalent circuit illustrated in FIG. 14B:

$$VR_{1-1}\times(VR_{2-2}+j\omega L_3)=VR_{1-2}\times(VR_{2-1}+j\omega L_1) \quad (1).$$

Figure 14C:
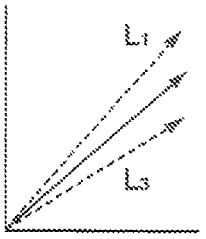

As a result, as illustrated in FIG. 14C, signals (indicated by dotted lines in the figure) of $L_1$, $L_3$ before the control are formed into signals (indicated by a solid line in the figure) of the same phase and the same amplitude.

Then, when the metallic film (or the conductive film) exists near the detection coils 864, 866, a magnetic field generated by an eddy current formed in the metallic film (or the conductive film) is interlined with the detection coils 864, 866 and the dummy coils 868, 870. However, since the detection coils 864, 866 are disposed in a position lying nearer to the metallic film (or the conductive film), a balance between an induced voltage generated in the detection coils 864, 866 and an induced voltage generated in the dummy coils 868, 870 is collapsed, whereby an interlinked magnetic flux generated by the eddy current in the metallic film (or the conductive film) can be detected by this collapse in the balance of the induced voltages. That is, a zero point control can be executed by separating the series circuit of the detection coils 864, 866 and the dummy coils 868, 870 from the exciting coils 860, 862 that are connected to the alternating-current signal source and controlling the balance by the resistance bridge circuit. Consequently, since the eddy current flowing to the metallic film (or the conductive film) can be detected from a zero state, the detection sensitivity of eddy current in the metallic film (or the conductive film) is enhanced. As a result, the magnitude of the eddy current generated in the metallic film (or the conductive film) can be detected over a wide dynamic range.

Figure 15:
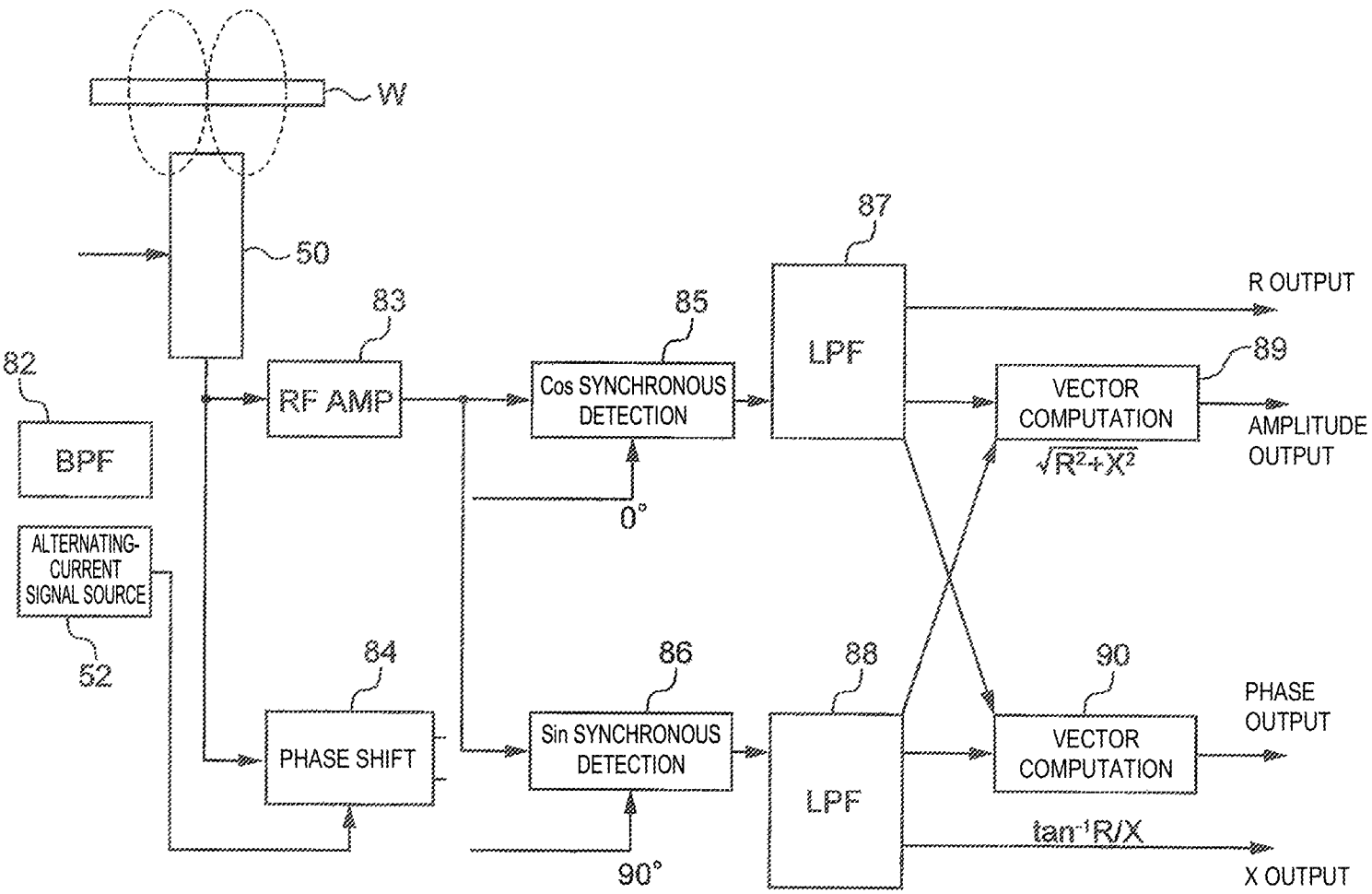
FIG. 15 is a block diagram illustrating a synchronous detection circuit of the eddy current sensor.

FIG. 15 is a block diagram illustrating a synchronous detection circuit of the eddy current sensor. In this figure, an example of a measuring circuit of impedance Z seen from the side of the alternating-current signal source 52 toward the eddy current sensor 56 side is illustrated. In the measuring circuit of impedance Z illustrated in this figure, a resistance component (R), a reactance component (X), an amplitude output (Z), and a phase output ($\tan^{-1}R/X$), which change in association with a change in film thickness, can be fetched.

As described above, the signal source 52, which is configured to supply an alternating-current signal to the eddy current sensor 56 disposed near the semiconductor wafer 16 on which the metallic film (or the conductive film) constituting the detection target is formed, is the oscillator of the fixed frequency that is made up of a crystal oscillator and supplies a voltage of a fixed frequency of, for example, 2 MHz, 8 MHz, or 16 MHz. Alternating-current voltage formed by the signal source 52 is supplied to the eddy current sensor 56 via the signal source 52. A cos component and a sin component of a signal detected at the terminals of the eddy current sensor 56 are fetched by a synchronous detection section that is made up of a cos synchronous detection circuit 85 and a sin synchronous detection circuit 86 via a high-frequency amplifier 83 and a phase shift circuit 84. Here, as an oscillation signal formed by the signal source 52, two signals of an in-phase component (0°) and an orthogonal component (90°) of the signal source 52 are formed by the phase shift circuit 84 and are introduced into the cos synchronous detection circuit 85 and the sin synchronous detection circuit 86 respectively, whereby the synchronous detection is executed as described above.

Unnecessary high frequency components that are equal to or greater than the signal components are removed from the signals that are synchronously detected by low-pass filters 87, 88, whereby a resistance component (R) output, which is a cos synchronous detection output, and a reactance component (X) output, which is a sin synchronous detection output, are fetched. In addition, an amplitude output $(R^2+X^2)^{1/2}$ is obtained from the resistance component (R) output and the reactance component (X) output by a vector computing circuit 89. Similarly, a phase output ($\tan^{-1}R/X$) is obtained from the resistance component output and the reactance component output by a vector computing circuit 90. Here, various types of filters are provided on a measuring device main body to remove noise components of sensor signals. The various filters have cutoff frequencies that are set individually therefor. For example, by setting cutoff frequencies of the low-pass filters in a range from 0.1 to 10 Hz, a noise component mixed into a sensor signal at the time of polishing is removed, thereby making it possible to measure the metallic film (or the conductive film), which is the measuring target, highly accurately.

Figure 16B:
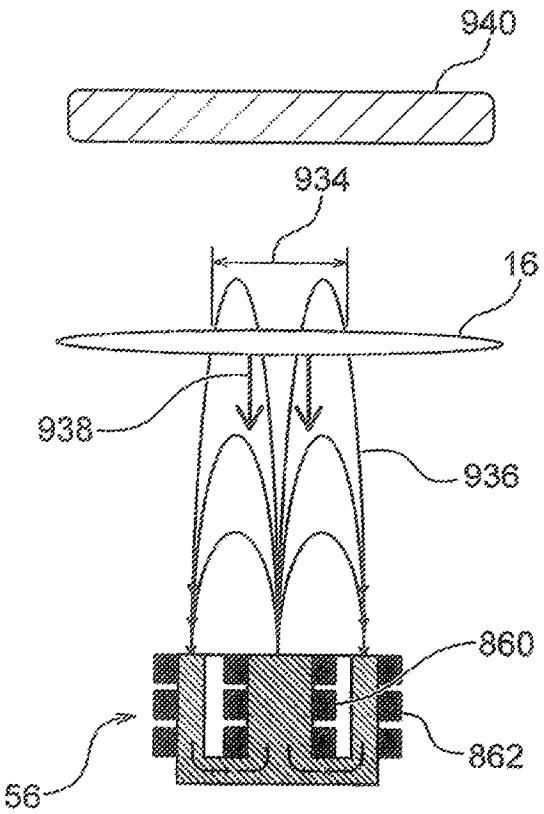
FIGS. 16A and 16B are diagrams illustrating a difference in expansion of a magnetic flux between a case where an external coil is wound around an external circumferential wall portion and a case where the external coil is not wound therearound.
Figure 16A:
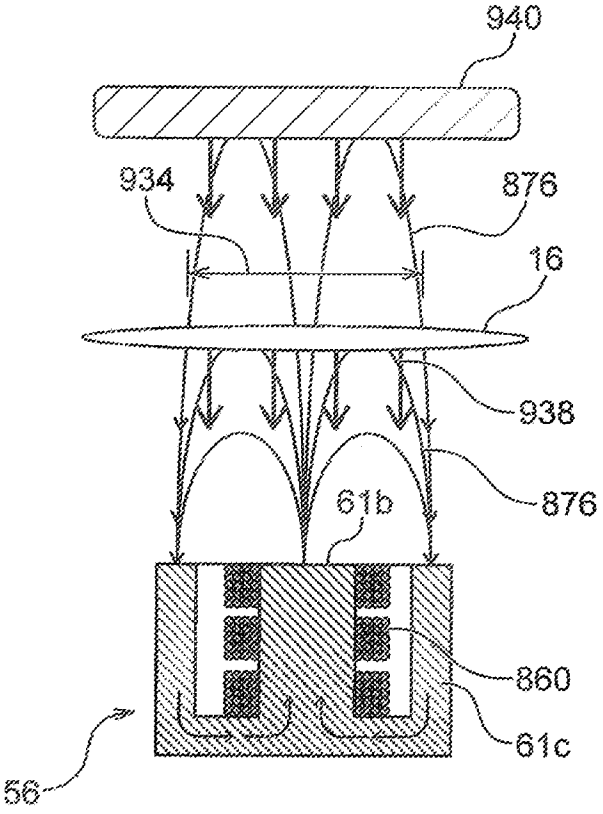

Next, a difference between an embodiment of an eddy current sensor 56 in which the exciting coil 860 is wound only around the inner magnet center section 61*b* and an embodiment of an eddy current sensor 56 in which the exciting coils are wound both around the inner magnetic center portion 61*b* and the outer circumferential wall portion 61*c* will be described by reference to FIG. 16. FIG. 16 shows diagrams illustrating a difference in expansion of a magnetic flux between the embodiments. FIG. 16A illustrates the embodiment of the eddy current sensor 56 in which the exciting coil 860 is wound only around the inner magnetic center portion 61*c*, and FIG. 16B illustrates the embodiment of the eddy current sensor 56 in which the exciting coils are wound both around the inner magnetic center portion 61*b* and the outer circumferential wall portion 61*c*.

In the eddy current sensor 56 illustrated in FIG. 16A, since the exciting coil 860 is wound only around the inner magnetic center portion 61*b*, an area 934 (a spot diameter) where the eddy current is generated inside the semiconductor wafer 16 becomes wide. On the other hand, in the eddy current sensor 56 illustrated in FIG. 16B, since the exciting coils are wound both around on the inner magnetic center portion 61*b* and the outer circumferential wall portion 61*c*, an area 934 (a spot diameter) where the eddy current is generated inside the semiconductor wafer 16 becomes narrow. A magnetic field 938 is a magnetic field (a demagnetizing field) that is generated by the generated eddy current.

In the eddy current sensor 56 illustrated in FIG. 16A, since the magnetic flux expands greatly, the magnetic field is formed to a far side. As a result, in the case where a metal 940 exists near the semiconductor wafer 16, there is caused a problem that the eddy current sensor 56 reacts to the metal 940. In the eddy current sensor 56 illustrated in FIG. 16B, the magnetic flux expands small, the magnetic field is not formed to a far side. As a result, there is an advantage that even though a metal 940 exists near the semiconductor wafer 16, the eddy current sensor 56 does not react to the metal 940. The metal 940 can be, for example, the metal (whose material is SUS or the like) used for the retainer ring 23 or the like of the top ring 31A.

The eddy current sensor 56 illustrated in FIG. 16A receives much noise from non-measuring target objects. The eddy current sensor 56 illustrated in FIG. 16B receives less noise than the noise that the eddy current sensor 56 in FIG. 16A receives and has a high sensitivity, as a result of which an end point detection can be executed more accurately. In the eddy current sensor 56 in FIG. 16B, since the magnetic field is not formed to the far side, the semiconductor wafer 16 is preferably disposed within a short distance from the eddy current sensor 56, that is, the eddy current detection device 50. A plurality of eddy current sensors 56 like the eddy current sensor 56 illustrated in FIG. 16B may be provided as illustrated in FIG. 6, whereby the strength of a signal obtained by a measurement can be enhanced. By providing the plurality of eddy current sensors 56 like the eddy current sensor 56 illustrated in FIG. 16B, compared with a case where only one eddy current sensor 56 like the eddy current sensor 56 in FIG. 16B is provided, the S/N ratio is increased, thereby enabling the execution of a highly accurate measurement.

Figure 17:
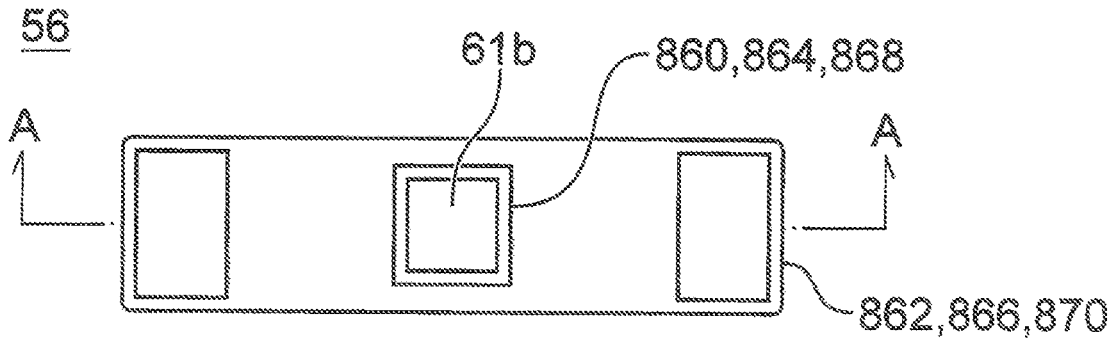
FIG. 17 is a diagram illustrating an example in which a circumferential magnetic material is not a wall portion that is provided on a circumferential portion of a bottom surface portion in such a manner as to surround a magnetic center portion.
Figure 18:
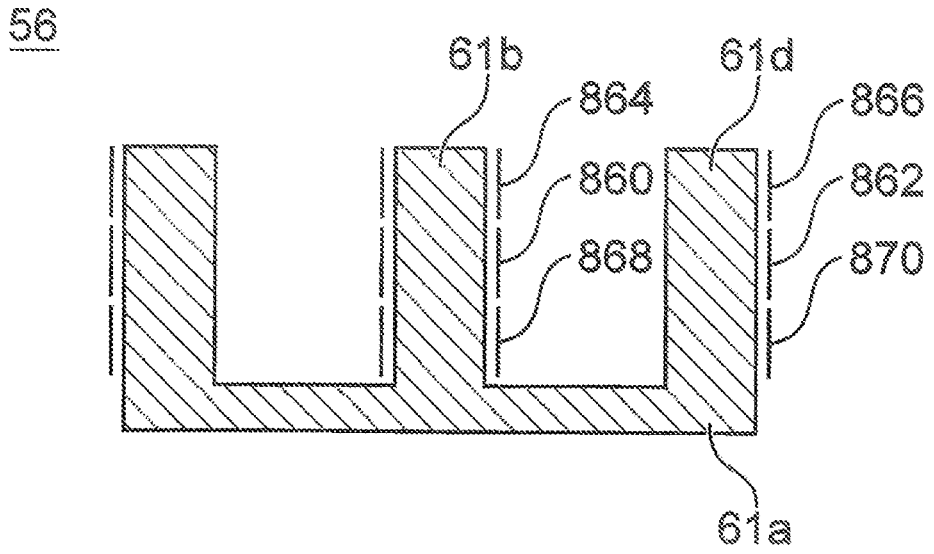
FIG. 18 is a diagram illustrating the example in which the circumferential magnetic material is not the wall portion that is provided on the circumferential portion of the bottom surface portion in such a manner as to surround the magnetic center portion.
Figure 19:
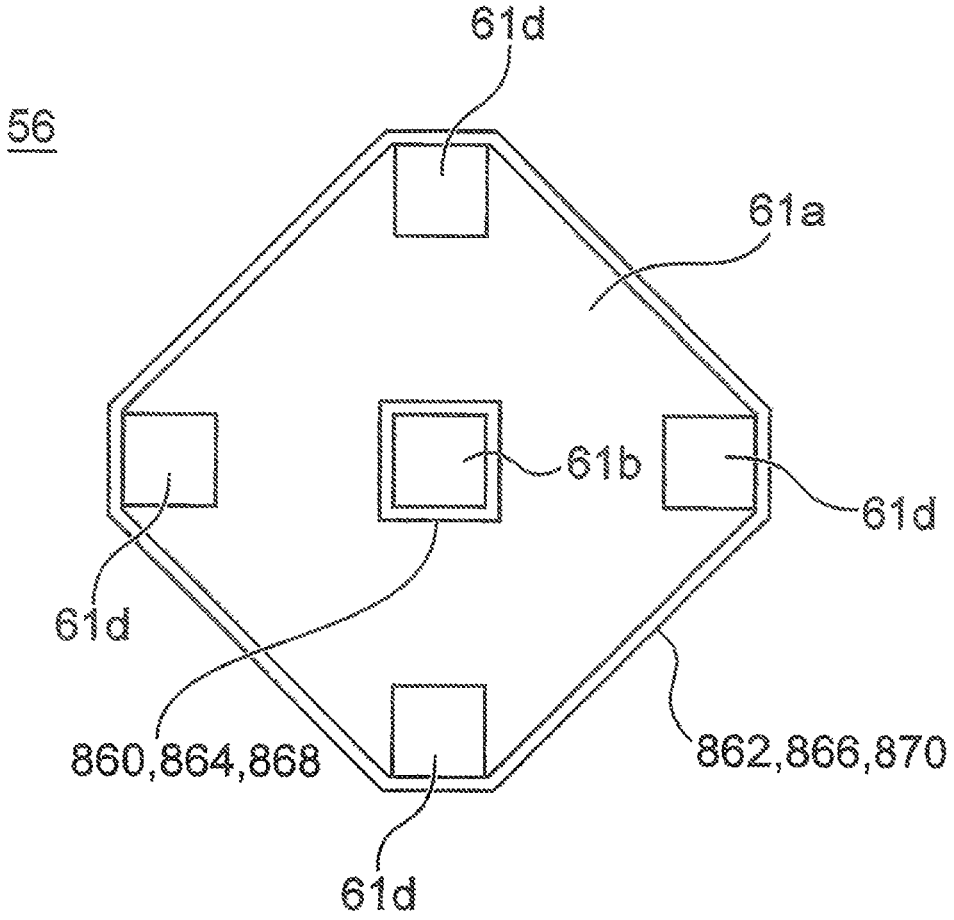
FIG. 19 is a diagram illustrating an example in which a circumferential magnetic material is not a wall portion that is provided on a circumferential portion of a bottom surface portion in such a manner as to surround a magnetic center portion.

Next, a different example will be described in which a circumferential magnetic element differs from the wall portion illustrated in FIG. 12 that is provided along the circumferential portion of the bottom surface portion 61*a* in such a manner as to surround the magnetic center portion 61*b* by reference to FIGS. 17 to 19. FIGS. 17 and 18 illustrates an eddy current sensor 56 in which a bottom surface portion 61*a* has a pillar-like shape, and a circumferential wall portion 61*c* (a circumferential portion) is disposed at both ends of the pillar-like shape. FIG. 17 is a top plan view. FIG. 18 is a cross-sectional view taken along a line A-A in FIG. 17. Two circumferential magnetic elements 61*d* are provided at a circumferential portion of the bottom surface portion 61*a*. As is seen from FIG. 18, this eddy current sensor 56 is an E-type magnetic device. FIG. 19 is a top plan view of an eddy current sensor 56 in which four circumferential magnetic elements 61*d* are provided at a circumferential portion of a bottom surface portion 61*a*. Five or more circumferential magnetic elements 61*d* may be provided.

Figure 20:
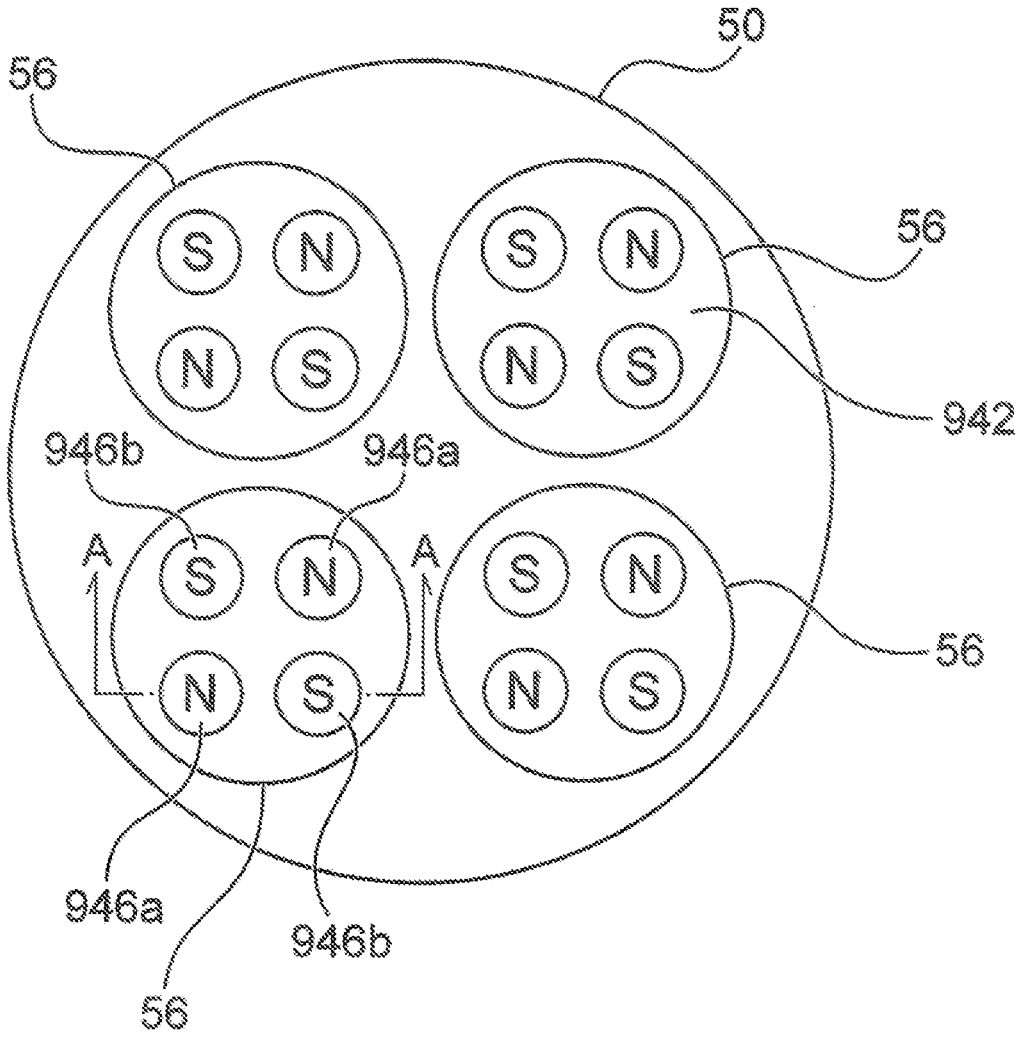
FIG. 20 is a plan view illustrating an eddy current detection device 50 according to the embodiment.
Figure 21:
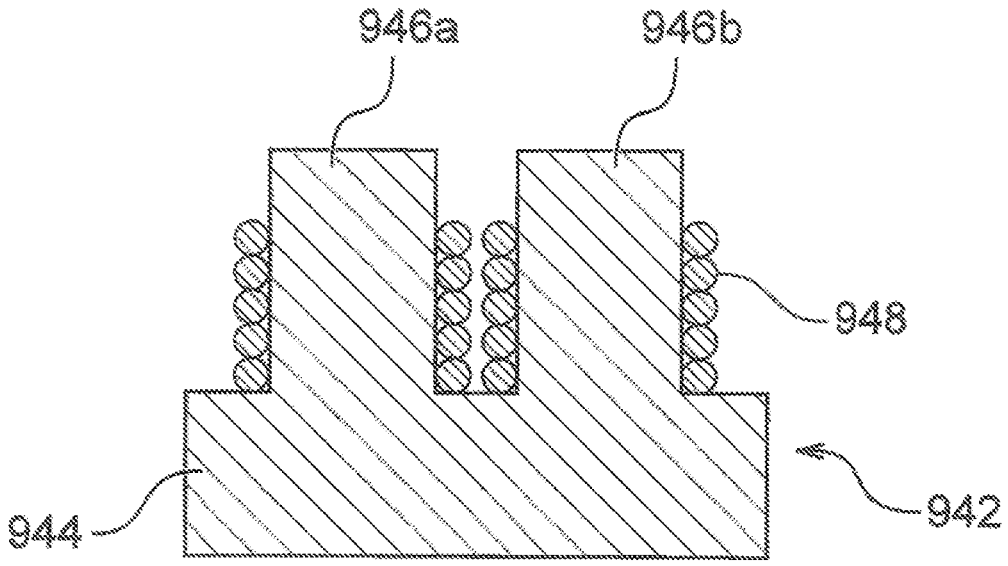
FIG. 21 is a cross-sectional view of one of eddy current sensors 56 illustrated in FIG. 20, taken along a line A-A.

Next, referring to FIGS. 20 and 21, another embodiment of an eddy current sensor 56 will be described. FIG. 20 is a plan view of an eddy current detection device 50. In the eddy current sensor 56 of the present embodiment, the eddy current detection device 50 includes for eddy current sensors 56. In the present embodiment, the four eddy current sensors 56 have the same configuration. The number of eddy current sensors 56 that the eddy current detection device 50 includes is not limited to four, and hence, the eddy current detection device 50 can include a plurality of eddy current sensors 56. The plurality of eddy current sensors 56 may be identical to one another in structure/size or may be different from one another in structure/size. FIG. 21 is a cross-sectional view of one of the eddy current sensors 56 illustrated in FIG. 20 taken along a line A-A in the figure.

As illustrated in FIG. 21, a core section 942 of the eddy current sensor 56 includes a bottom surface portion 944 having a cylindrical shape and four pillar-like portions 946 that extend perpendicularly from the bottom surface portion 944 towards a semiconductor wafer 16. The plurality of pillar-like portions 946 each include two first pillar-like portions 946*a* that can generate an N pole (a first magnetic polarity) and two pillar-like portions 946*b* that can generate an S pole (a second magnetic polarity) that is opposite to the N pole.

The shape of the bottom surface portion 944, the shape of the first pillar-like portion 946*a*, and the shape of the second pillar-like portion 946*b* are not limited to the cylindrical shape and hence may take the form of an oval pillar, a disk, or a prism. Additionally, the shape of the eddy current detection device 50 is not limited to the circular shape and hence may be an oval or a polygon. The number of pillar-like portions 946 that one eddy current sensor 56 includes is not limited to four and hence only needs to be two or more and in an even number or an odd number. The numbers of first pillar-like portions 946*a* and second pillar-like portions 946*b* that one eddy current sensor 56 includes are not limited to two and hence only need to be one or more.

A coil 948 is wound around the pillar-like portion 946. As the coil 948, an exciting coil and a detection coil may be provided separately, or one coil 948 may function as an exciting coil and a detection coil. That is, an exciting coil and a detection coil can constitute the same coil, and the exciting coil can be configured to detect an eddy current that is formed in a conductive film on a semiconductor wafer 16. The configuration in which the exciting coil and the detection coil constitute the same coil can also be applied to a combination of the exciting coil 860 and the detection coil 864 or a combination of the exciting coil 862 and the detection coil 866 illustrated in FIG. 9.

Thus, while the examples of the embodiments of the present invention have been described heretofore, the embodiments of the present invention that have been described heretofore are intended to facilitate the understanding of the present invention but are not intended to limit the present invention. The present invention can be modified or improved without departing from the spirit and scope thereof, and its equivalents are, of course, included in the present invention. Additionally, the constituent elements described in claims below and the description can arbitrarily be combined or omitted as long as at least a part of the problems described above is solved or at least a part of the effects described above is realized.

This application claims priority under the Paris Convention to Japanese Patent Application No. 2018-210865 filed on Nov. 8, 2018. The entire disclosure of Japanese Patent Laid-Open No. 2017-58245 including specification, claims, drawings and summary is incorporated herein by reference in its entirety.

REFERENCE SIGNS LIST

10 . . . Polishing pad
16 . . . Semiconductor wafer
3A . . . First polishing unit
50 . . . Eddy current detection device
56 . . . Eddy current sensor
60 . . . Pot core
65 . . . Control section
30A . . . Polishing table
61*a* . . . Bottom surface portion
61*b* . . . Magnetic center portion
61*c* . . . Circumferential wall portion
860 . . . Exciting coil
862 . . . Exciting coil
864 . . . Detection coil
866 . . . Detection coil
876 . . . Magnetic field
878 . . . Magnetic field
936 . . . Magnetic field
942 . . . Core section
944 . . . Bottom surface portion
946 . . . Pillar-like section
948 . . . Coil
946*a* . . . First pillar-like section
946*b* . . . Second pillar-like section

What is claimed is:

1. An eddy current detection device capable of being disposed near a polishing target on which a conductive film is formed, the eddy current detection device comprising:

a plurality of eddy current sensors, the plurality of eddy current sensors being disposed next to each other, the plurality of eddy current sensors being separate from each other, wherein each of the plurality of eddy current sensors comprises:

a core section;

an exciting coil disposed in the core section and configured to form an eddy current in the conductive film; and a detection coil disposed in the core section and configured to detect the eddy current formed in the conductive film, wherein the plurality of core sections comprised in the plurality of eddy current sensors are separate from each other, and wherein an inter-center distance between adjacent eddy current sensors of the plurality of eddy current sensors is twice a length or smaller of an external shape of the adjacent eddy current sensors.

2. The eddy current detection device according to claim 1, wherein in at least one eddy current sensor of the plurality of eddy current sensors, the exciting coil and the detection coil constitute a same coil, and wherein the exciting coil can detect the eddy current formed in the conductive film.

3. The eddy current detection device according to claim 1, wherein in at least one eddy current sensor of the plurality of eddy current sensors, the core section comprises: a bottom surface portion; a magnetic center portion provided at a center of the bottom surface portion; and a circumferential portion provided on a circumference of the bottom surface portion, and wherein the exciting coil and the detection coil are disposed at the magnetic center portion.

4. The eddy current detection device according to claim 3, wherein the exciting coil and the detection coil are disposed at the circumferential portion, in addition to the magnetic center portion.

5. The eddy current detection device according to claim 3, wherein the circumferential portion constitutes a circumferential wall portion that is provided on a circumference of the bottom surface portion in such a manner as to surround the magnetic center portion.

6. The eddy current detection device according to claim 3, wherein the bottom surface portion has a pillar shape, and wherein the circumferential portion is disposed at both ends of the pillar shape.

7. The eddy current detection device according to claim 3, wherein a plurality of circumferential portions are provided on the circumference of the bottom surface portion.

8. The eddy current detection device according to claim 1, wherein in at least one eddy current sensor of the plurality of eddy current sensors, the core section comprises: a bottom surface portion; and a plurality of pillars extending from the bottom surface portion in a normal direction towards the polishing target, and wherein the plurality of pillars comprise: a plurality of first pillars that can generate a first magnetic polarity; and a plurality of second pillars that can generate a second magnetic polarity that is opposite to the first magnetic polarity.

9. The eddy current detection device according to claim 1, wherein the plurality of eddy current sensors are disposed, to form a polygon, at vertices of the polygon and/or along sides of the polygon and/or in an interior of the polygon.

10. The eddy current detection device according to claim 1, wherein the plurality of eddy current sensors are disposed linearly to form a straight line.

11. A polishing apparatus, comprising:

a polishing table to which a polishing pad for polishing a polishing target can be affixed;

a drive section configured to rotationally drive the polishing table;

a holding section configured to press the polishing target against the polishing pad by holding the polishing target;

the eddy current detection device according to claim 1 that is disposed in an interior of the polishing table, wherein the eddy current formed in the polishing target by the exciting coil in association with rotation of the polishing table is detected by the detection coil; and an end point detecting section configured to detect a polishing end point indicating an end of polishing of the polishing target from the detected eddy current.

* * * * *